US012247305B2

(12) United States Patent
Reid et al.

(10) Patent No.: US 12,247,305 B2
(45) Date of Patent: Mar. 11, 2025

(54) ELECTROLYTIC GENERATION AND PURIFICATION OF CARBON

(71) Applicant: Maple Materials, Inc., Richmond, CA (US)

(72) Inventors: Drew Lawrence Reid, Berkeley, CA (US); Benjamin Mark Rush, Oakland, CA (US); Daniel Ricardo Ahumada, Berkeley, CA (US); Kenneth Reid, Piedmont, CA (US)

(73) Assignee: Maple Materials, Inc., Richmond, CA (US)

( * ) Notice: Subject to any disclaimer, the term of this patent is extended or adjusted under 35 U.S.C. 154(b) by 198 days.

(21) Appl. No.: 17/247,533

(22) Filed: Dec. 15, 2020

(65) Prior Publication Data

US 2021/0108320 A1 Apr. 15, 2021

Related U.S. Application Data

(62) Division of application No. 16/146,882, filed on Sep. 28, 2018, now Pat. No. 10,900,134.

(Continued)

(51) Int. Cl.
*C25B 15/08* (2006.01)
*C25B 1/00* (2021.01)

(Continued)

(52) U.S. Cl.
CPC ..... *C25B 15/08* (2013.01); *C25B 1/00* (2013.01); *C25B 1/135* (2021.01); *C25B 1/14* (2013.01);

(Continued)

(58) Field of Classification Search
CPC ..... C25B 9/09; C25B 1/135
See application file for complete search history.

(56) References Cited

U.S. PATENT DOCUMENTS 4,028,199 A 6/1977 Holland
4,609,451 A 9/1986 Sammells et al.

(Continued)

FOREIGN PATENT DOCUMENTS

EP 1361194 11/2003

OTHER PUBLICATIONS

Ingram et al., "The Electrolytic Deposition of Carbon from Fused Carbonates," Electrochimica Acta, 1966, vol. 11, pp. 1629 to 1639 (Year: 1966).*

(Continued)

*Primary Examiner* — Salil Jain
(74) *Attorney, Agent, or Firm* — Weaver Austin Villeneuve & Sampson LLP

(57) ABSTRACT

The embodiments herein relate to methods, apparatus, and systems for forming and purifying solid carbon material from a molten carbonate salt electrolyte. Various embodiments also provide methods, apparatus, and systems for recycling certain materials including the carbonate salt electrolyte, carbon dioxide, water, etc. Advantageously, the system utilizes carbon dioxide in one or more processes, for example to purify the solid carbon and regenerate the carbonate salt electrolyte. These methods, apparatus, and systems provide an efficient technique to consume carbon dioxide in the production of solid carbon, with substantial advantages over systems that attempt to form solid carbon from a stream of carbon dioxide provided directly to an electrolysis reactor.

14 Claims, 12 Drawing Sheets

Related U.S. Application Data

(60) Provisional application No. 62/564,956, filed on Sep. 28, 2017.

(51) Int. Cl.

| | |
|---|---|
| ***C25B 1/135*** | (2021.01) |
| ***C25B 1/14*** | (2006.01) |
| ***C25B 9/09*** | (2021.01) |
| ***C25B 9/19*** | (2021.01) |
| ***C25B 11/042*** | (2021.01) |
| ***C25B 11/046*** | (2021.01) |

(52) U.S. Cl.

CPC ..... *C25B 9/09* (2021.01); *C25B 9/19* (2021.01); *C25B 11/042* (2021.01); *C25B 11/046* (2021.01); *C25B 15/081* (2021.01); *C25B 15/087* (2021.01)

(56) References Cited

U.S. PATENT DOCUMENTS

| | | | | |
|---|---|---|---|---|
| 5,618,392 | A | 4/1997 | Furuya | |
| 6,435,130 | B1 | 8/2002 | Takaki et al. | |
| 9,028,789 | B2 | 5/2015 | Brito da Silva Correia | |
| 9,290,853 | B2 | 3/2016 | Elgammal et al. | |
| 2004/0108200 | A1 | 6/2004 | Des Jardins et al. | |
| 2011/0100832 | A1 | 5/2011 | Lubomirsky et al. | |
| 2013/0287672 | A1* | 10/2013 | Chae | C01F 11/18 423/431 |
| 2013/0302237 | A1 | 11/2013 | Correia | |
| 2014/0202874 | A1* | 7/2014 | Elgammal | C25B 15/08 205/555 |
| 2019/0093246 | A1 | 3/2019 | Reid et al. | |
| 2019/0271088 | A1* | 9/2019 | Licht | C25D 9/08 |

OTHER PUBLICATIONS

US Non-Final Office Action dated Jul. 29, 2015, issued in U.S. Appl. No. 13/950,055.

US Final Office Action dated Oct. 7, 2015, issued in U.S. Appl. No. 13/950,055.

US Notice of Allowance dated Jan. 29, 2016, issued in U.S. Appl. No. 13/950,055.

US Non-Final Office Action dated Jul. 2, 2020, issued in U.S. Appl. No. 13/950,055.

US Non-Final Office Action dated Aug. 5, 2020, issued in U.S. Appl. No. 13/950,055.

US Notice of Allowance dated Oct. 19, 2020, issued in U.S. Appl. No. 13/950,055.

Douglas, et al., "Iron catalyzed growth of crystalline multi-walled carbon nanotubes from ambient carbon dioxide mediated by molten carbonates," Carbon, No. 116, 2017, pp. 572-578.

Johnson, et al., "Carbon nanotube wools made directly from CO2 by molten electrolysis: Value driven pathways to carbon dioxide greenhouse gas mitigation," Material today Energy, 5, 2017, pp. 230-236.

Saratoga Energy Research Partners, LLC Grant Application, "Supercritical Carbon Dioxide Assisted Purification of Electrolytically Synthesized Graphite," NSF-SBIR 16-554 Project Description, 15 pages.

SkyNano Technologies,"Rethink Carbon Dioxide," Webpage Located at https://www.skynanotechnologies.com/, 2 pages.

Carbon XPrize, "Transforming CO2 Into Valuable Products," Webpage Located at https://carbon.xprize.org/prizes/carbon, 7 pages.

Ingram, M. D., et al., "The Electrolytic Deposition of Carbon from Fused Carbonates," Electrochimica Acta, 1966, 11, 1620-1639.

Kaplan, B., et al., "Synthesis and Structural Characterization of Carbon Powder by Electrolytic Reduction of Molten Li2COr Na2COr K2C03," Journal of the Electrochemical Society, 2002, 149, D72-D78.

Groult, H., et al., "Preparation of Carbon Nanoparticles from Electrolysis of Molten Carbonates and Use as Anode Materials in Lithium-Ion Batteries," Solid State Ionics, 2006, 177, 869-875.

Le Van, K., et al., "Electrochemical Formation of Carbon Nano-Powders with Various Porosities in Molten Alkali Carbonates," Electrochimica Acta, 2009, 54, 4566-4573.

Kaplan, V., et al., "Conversion of CO2 to CO by Electrolysis of Molten Lithium Carbonate," Journal of the Electrochemical Society, 2010, 157, B552-B556.

Kamali, A.R., et al., "Effect of the Graphite Electrode Material on the Characteristics of Molten Salt Electrolytically Produced Carbon Nanomaterials," Materials Characterization, 2011, 62, 987-994.

Yin, H. Y. et al., "Capture and Electrochemical Conversion of CO2 to Value-Added Carbon and Oxygen by Molten Salt Electrolysis," Energy & Environmental Science, 2013, 6, 1538-1545.

* cited by examiner

ELECTROLYTIC GENERATION AND PURIFICATION OF CARBON

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in its entirety and for all purposes.

BACKGROUND

Graphite is a form of crystalline carbon. The carbon atoms within graphite are densely arranged in parallel-stacked, planar, honeycomb-lattice sheets. Graphite is a soft mineral which exhibits perfect basal cleavage. It is flexible but not elastic, has a low specific gravity, is highly refractory, and has a melting point of 3,927° C. Of the non-metals, graphite is the most thermally and electrically conductive, and it is chemically inert. These properties make graphite beneficial for numerous applications in a range of fields. Worldwide demand for graphite and other solid forms of carbon has increased in recent years, and is expected to continue to increase as global economic conditions improve and further applications are developed.

Some examples of the uses of graphite and other forms of solid carbon include use as a steel component, static and dynamic seals, low-current, long-life batteries (particularly lithium ion batteries), rubber, powder metallurgy, porosity-enhancing inert fillers, valve and stem packing, and solid carbon shapes. Graphite is also used in the manufacture of supercapacitors and ultracapacitors, catalyst supports, anti-static plastics, electromagnetic interference shielding, electrostatic paint and powder coatings, conductive plastics and rubbers, high-voltage power cable conductive shields, semi-conductive cable compounds, and membrane switches and resistors. In some cases, solid carbon may be used to form various materials including, but not limited to, polymer composites, metal matrix composites, carbon-carbon composites, ceramic composites, and combinations thereof.

In recent years, graphite and other forms of solid carbon have been important in the emerging non-carbon energy sector, and they have been used in several new energy applications such as in pebbles for modular nuclear reactors and in high-strength composites for wind, tide and wave turbines. Solid carbon has also been used in energy storage applications such as bipolar plates for fuel cells and flow batteries, anodes for lithium-ion batteries, electrodes for supercapacitors, phase change heat storage, solar boilers, and high-strength composites for flywheels. Furthermore, graphite is used in energy management applications such as high-performance polystyrene thermal insulation and silicon heat dissipation.

DETAILED DESCRIPTION

I. Introduction and Overview

Figure 1:
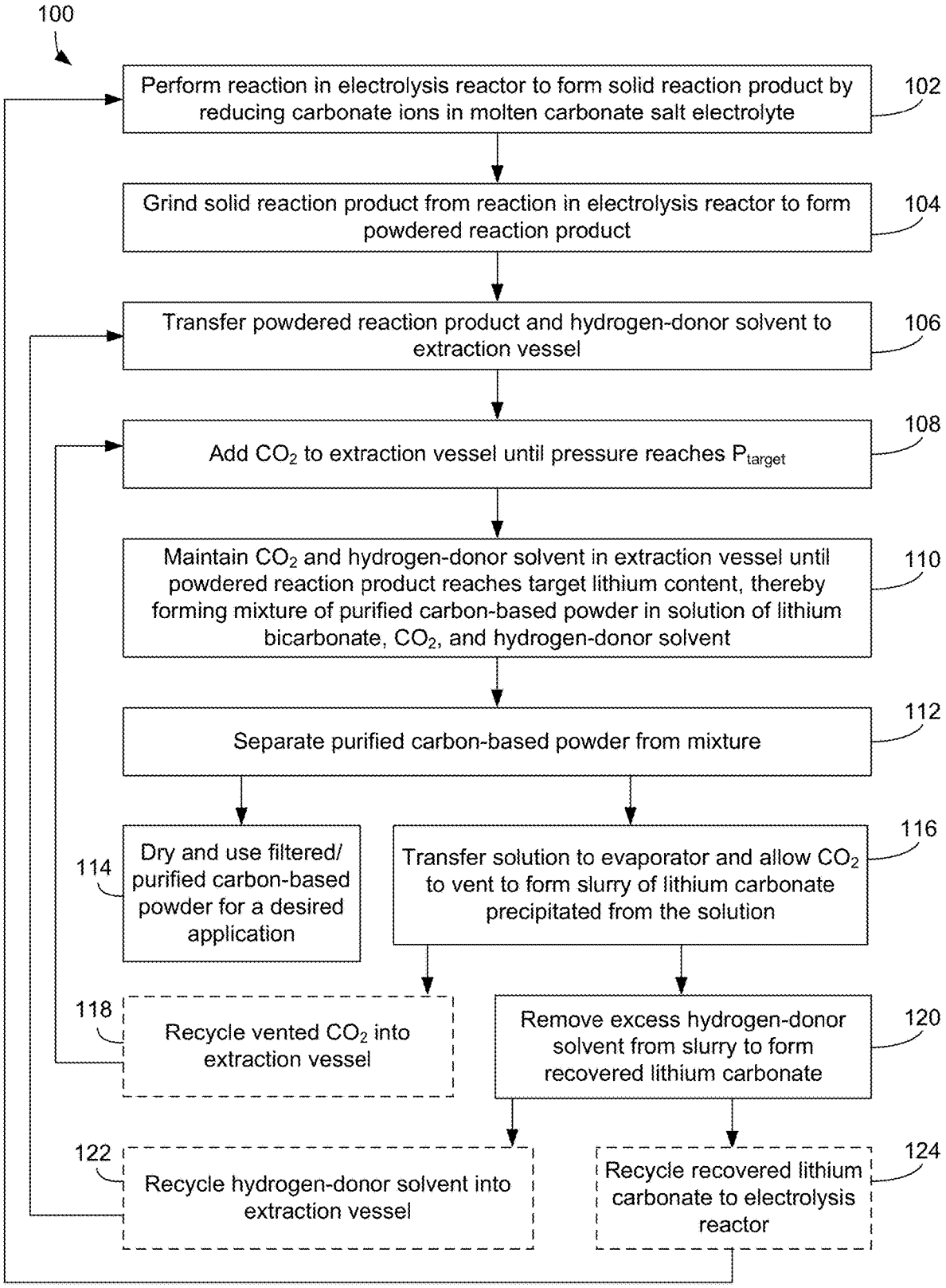
FIG. 1 is a flowchart describing a method of generating and purifying solid carbon according to various embodiments.

In certain implementations, the embodiments disclosed herein provide improved methods of generating and purifying solid carbon. In various embodiments, the solid carbon is electrolytically generated at a cathode of an electrolysis reactor. Molten carbonate salt electrolyte (e.g., lithium carbonate) is provided in the electrolysis reactor, and solid carbon is produced as carbonate ions are reduced at the cathode. The carbonate ions are primarily generated from the molten carbonate salt electrolyte.

The electrolysis reactor produces a reaction product that includes solid carbon, lithium oxide ($Li_2O$), and unreacted lithium carbonate ($Li_2CO_3$). The unreacted lithium carbonate is from the carbonate salt electrolyte. After the reaction product is removed from the electrolysis reactor, it is cooled to form a solid reaction product. The solid reaction product may also include other materials, including but not limited to other carbonate salts present in the electrolysis reactor. The other carbonate salts (e.g., sodium carbonate, potassium carbonate, etc.) may be provided to adjust a melting temperature of the electrolyte, or for another purpose.

Because the solid reaction product includes on the order of about 15 wt % solid carbon, the carbon needs to be purified before it can be used for most applications. The purification involves separating the solid carbon from the lithium oxide and the lithium carbonate. One advantage of the purification process is that it regenerates lithium carbonate, which can be recycled to the electrolysis reactor. Because lithium carbonate is a relatively expensive material, such recycling can substantially reduce the cost of producing the solid carbon. Another advantage of the purification process is that it uses carbon dioxide ($CO_2$) as a feedstock.

Carbon dioxide is a widely available raw material and its release into the atmosphere is responsible for environmental degradation. The extensive burning of fossil fuels for generating electricity and other industrial processes results in the release of large amounts of greenhouse gases such as carbon dioxide, thereby increasing the concentration of $CO_2$ in the atmosphere. There is a growing consensus among the scientific community that the increasing concentration of $CO_2$ in the atmosphere is contributing to global warming. The consequences of global warming include melting of polar ice caps, rising sea levels, endangering coastal communities, threatening arctic and other ecosystems, and increasingly frequent extreme weather events such as heat spells, droughts, and hurricanes. Thus, there exists a need for methods which provide for the sequestration of $CO_2$ generated from the burning of fossil fuels and other industrial applications.

Some methods of electrolytic carbon generation use carbon dioxide as a feedstock in the electrolytic reactor. However, it has been found that carbon dioxide parasitically reacts with solid carbon, thus reducing the electrolysis yield. In the methods described herein, carbon dioxide is used as a feedstock to purify the solid carbon after it is generated in the electrolysis reactor. Some of the carbon dioxide is consumed as the solid carbon is purified and the lithium carbonate is regenerated. The regenerated lithium carbonate can then be recycled to the electrolysis reactor, where it reacts to form additional solid carbon. This technique provides a much more efficient way to consume carbon dioxide in the generation and purification of solid carbon, as compared to providing the carbon dioxide directly to the electrolysis reactor.

As used herein, the term "solid carbon" includes graphite, carbon black, amorphous carbon, carbon nanotubes, graphene, activated carbon, fullerenes, and similar solid elemental carbon materials that are formed in the electrolysis reactor. The term solid carbon does not include the carbon that is found in compounds such as lithium carbonate or lithium bicarbonate ($LiHCO_3$). Solid carbon includes only carbon atoms, except to the extent that any impurities are present.

The solid carbon formed at the cathode may coat and adhere to the cathode. Therefore, the electrolysis reactor may employ a mechanism to dislodge or otherwise separate the graphite from the cathode. In some cases, this mechanism vibrates or otherwise agitates the positive electrode with sufficient energy to shear the graphite from the electrode. In one example, the mechanism vibrates the cathode at or near its resonance frequency. In other implementations, the mechanism vibrates the electrolyte through sonication. Operated in these manners, deposited graphite dislodges from the electrode and forms a suspension in the electrolyte. In another approach, the cathode is scraped continuously or periodically to remove deposited graphite. In some cases, the cathode rotates or otherwise moves with respect to a fixed position scraper. In other embodiments, a scraper moves with respect to a fixed position cathode. Regardless of how the solid carbon is dislodged from the cathode, the carbon needs to be separated from the other components in the reaction product. The techniques described herein utilize carbon dioxide and a hydrogen-donor solvent to purify the solid carbon and regenerate the lithium carbonate electrolyte.

II. Electrochemical Reactions

1. Cathode Reaction in Electrolysis Reactor

At the cathode, one or more carbon-containing reactants are reduced to form a solid carbon material. In many cases, the following reactions occur at the cathode:

$$Li_2CO_{3(l)} \leftrightarrow 2Li^+_{(aq)} + CO_3^{2-}{}_{(aq)} \quad \text{Equation 1:}$$

$$CO_3^{2-}{}_{(aq)} + 4e^- \leftrightarrow C_{(s)} + 3O^{2-}{}_{(aq)} \quad \text{Equation 2:}$$

$$2Li^+_{(aq)} + O^{2-}{}_{(aq)} \leftrightarrow Li_2O_{(s)} \quad \text{Equation 3:}$$

The lithium carbonate electrolyte dissociates into lithium ions ($Li^+$) and carbonate ions ($CO_3^{2-}$), as shown in Equation 1. The reduction of the carbonate ion consumes four electrons and produces one carbon and three oxygen anions ($O^{2-}$), as shown in Equation 2. One oxide anion reacts with two lithium ions to produce lithium oxide, as shown in Equation 3.

The carbonate ion may originate from the electrolyte directly (e.g., as part of the bulk electrolyte provided before or during electrolysis). In some cases, additional carbonate ions may be formed through the reaction of dissolved carbon dioxide with oxide ion in the molten electrolyte. However, as mentioned above, carbon dioxide parasitically reacts with solid carbon. As such, in many cases carbon dioxide is not fed to the electrolysis reactor, and most or all of the carbonate ions originate from the carbonate salt electrolyte (e.g., from the lithium carbonate, optionally from other carbonate salts as desired for a particular application).

Figure 2A:
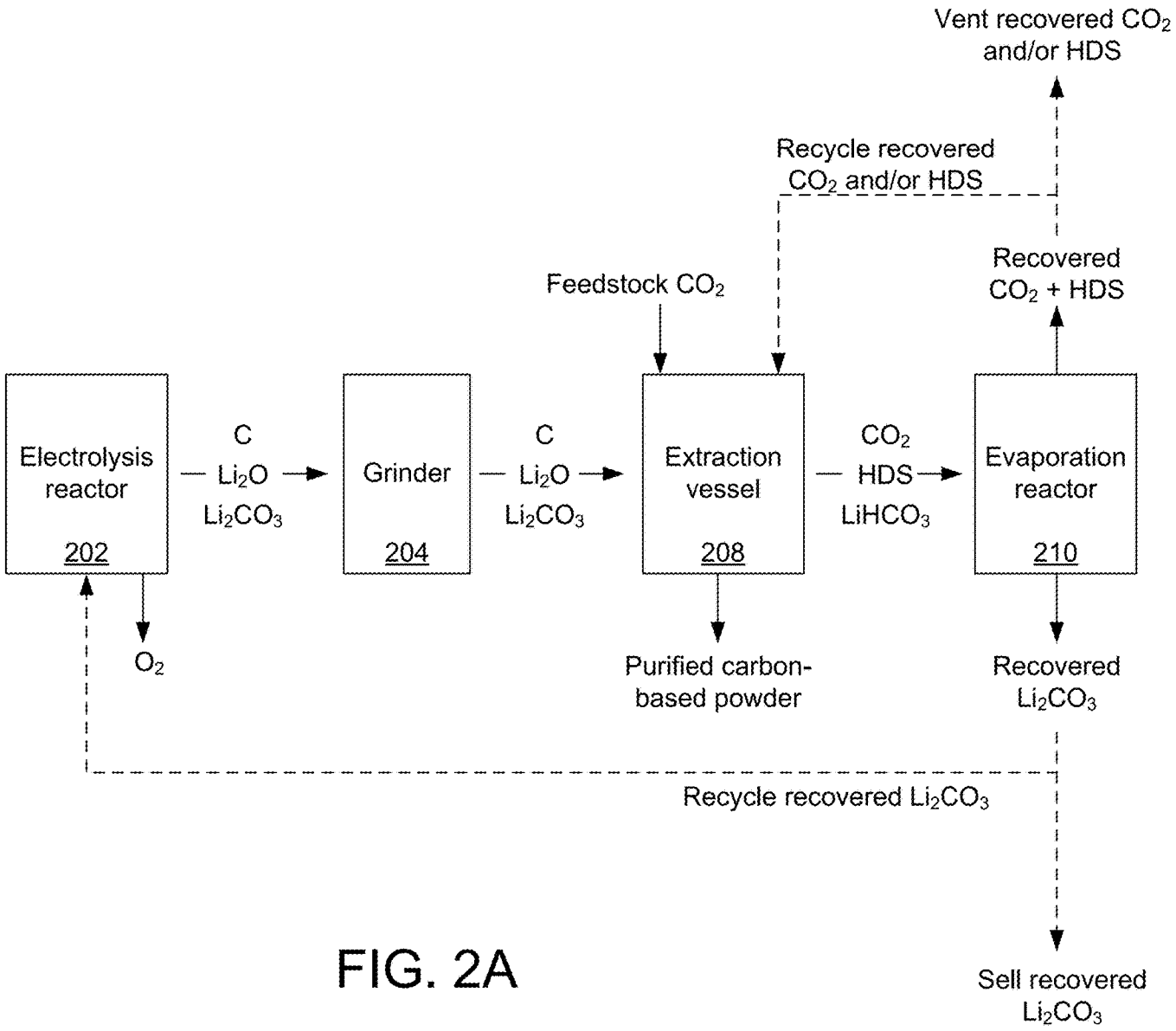
FIGS. 2A and 2B are block diagrams illustrating a system for generating and purifying solid carbon according to certain implementations.
Figure 2B:
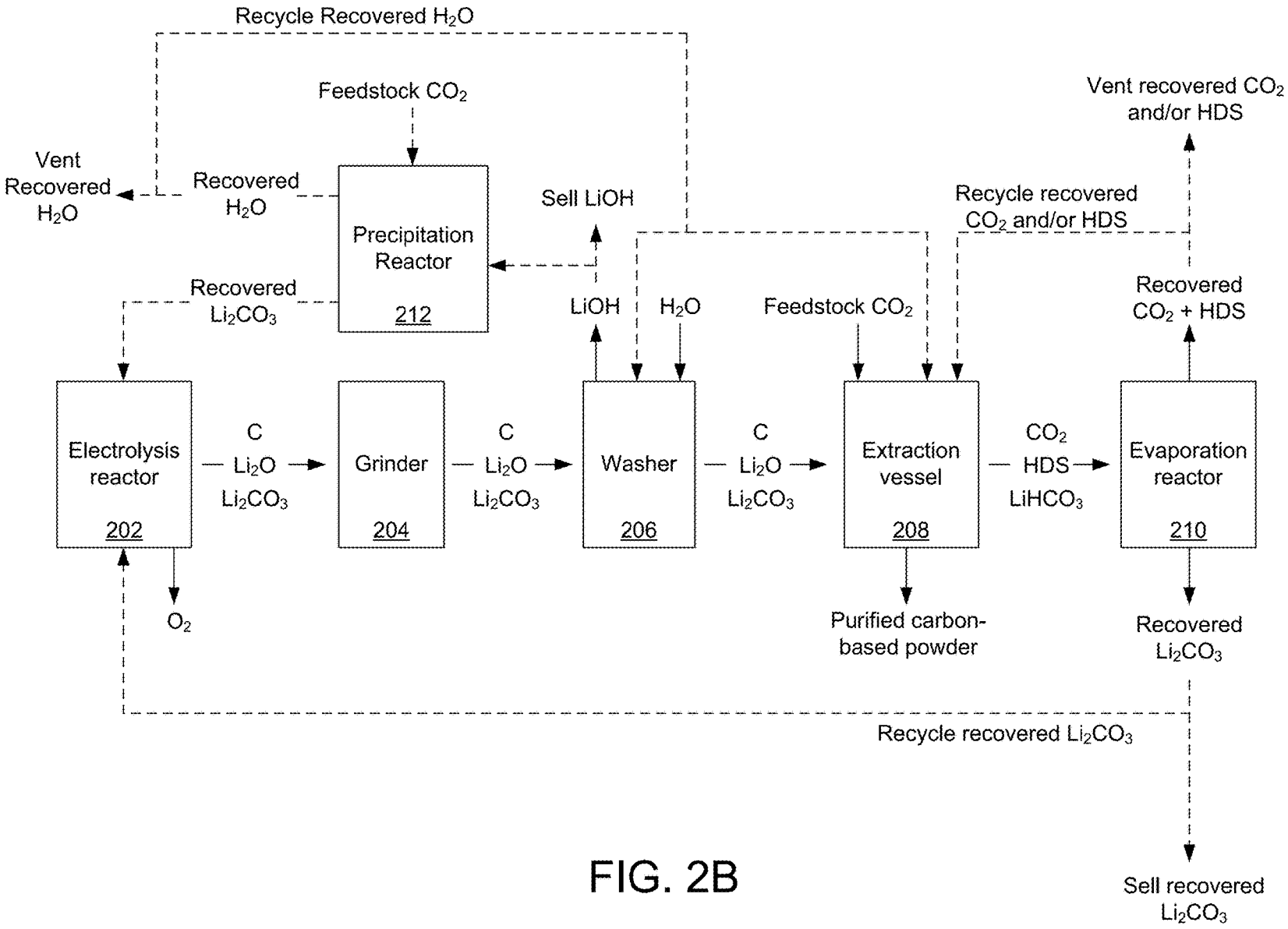

With reference to FIGS. 2A and 2B, described further below, these reactions may take place in electrolysis reactor 202.

2. Anode Reaction in the Electrolysis Reactor

In various embodiments, elemental oxygen ($O_2$) evolves at the anode. As mentioned, oxide anion is produced at the cathode through reduction of the carbonate anion (and in some cases reduction of carbon dioxide, if fed to the electrolysis reactor). The anode reaction may be represented as follows:

$$2O^{2-}{}_{(aq)} \leftrightarrow O_{2(g)} + 4e^- \quad \text{Equation 4:}$$

In cases where carbon dioxide is fed to the electrolysis reactor, another reaction which may occur at the anode is the formation of carbonate ion from carbon dioxide and oxide anion according to the following reaction:

$$CO_{2(g)} + O^{2-}{}_{(aq)} \leftrightarrow CO_3^{2-}{}_{(aq)} \quad \text{Equation 5:}$$

This reaction may help replenish carbonate ion in the electrolyte in certain embodiments where carbon dioxide is fed to the electrolysis reactor. As mentioned above, the carbon dioxide is omitted from the electrolysis reactor in many cases. With reference to FIGS. 2A and 2B, described further below, these reactions may take place in electrolysis reactor 202.

3. Reaction in Washer

In some embodiments, a washer is provided to wash the solid reaction product with water before the solid reaction product is provided to an extraction vessel, where the solid carbon is purified. In some other embodiments, the washer may be omitted. Before the solid reaction product is washed, it may be ground in a grinder to form a powder, as discussed further below. When the solid reaction product is washed with water, some of the lithium oxide in the reaction product reacts with water to form lithium hydroxide (LiOH), as shown in Equation 6:

$$Li_2O_{(s)} + H_2O_{(l)} \leftrightarrow 2LiOH_{(aq)} \quad \text{Equation 6:}$$

The lithium hydroxide is aqueous, and can therefore be easily separated from the remaining solid materials (e.g., carbon, lithium carbonate, and unreacted lithium oxide) using a liquid-solid separator. In some cases, the lithium hydroxide may be sold, or it may be contacted with carbon dioxide in a precipitation reactor to form recovered lithium carbonate and water, as shown in Equation 7, below.

With reference to FIG. 2B, described further below, the reaction in Equation 6 may take place in washer 206.

4. Reaction in Precipitation Reactor

In some cases where the solid reaction product is washed in a washer as described above, the lithium hydroxide that forms during washing is contacted with carbon dioxide to generate recovered lithium carbonate, as shown in Equation 7:

$$2LiOH_{(aq)}+CO_{2(g)}\leftrightarrow Li_2CO_{3(s)}+H_2O_{(l)}$$ Equation 7:

The recovered lithium carbonate can be sold, or it can be recycled to the electrolysis reactor for production of additional solid carbon.

With reference to FIG. 2B, described further below, the reaction in Equation 7 may occur in precipitation reactor 212.

5. Reaction in Extraction Vessel

The solid reaction product is fed to the extraction vessel. In some cases, the solid reaction product is ground into powder and/or washed before it is delivered to the extraction vessel, as mentioned above. In cases where the solid reaction product is not washed before delivery to the extraction vessel, the composition of the solid reaction product delivered to the extraction vessel typically includes between about 5-50 wt % solid carbon, between about 5-50 wt % lithium oxide, and between about 5-50 wt % lithium carbonate. In cases where the solid reaction product is washed before delivery to the extraction vessel, the lithium oxide content of the solid reaction product delivered to the extraction vessel is lower due to the reaction of some lithium oxide with water to form lithium hydroxide in the washer. As such, in cases where the solid reaction product is washed before delivery to the extraction vessel, the composition of the solid reaction product delivered to the extraction vessel may include between about 50-100 wt % solid carbon, between about 0-30 wt % lithium oxide, and between about 0-30 wt % lithium carbonate. In these or other cases, the solid reaction product delivered to the extraction vessel may include at least about 0.5 wt % lithium oxide and/or at least about 0.5 wt % lithium carbonate.

Carbon dioxide and a hydrogen-donor solvent are fed to the extraction vessel along with the solid reaction product. In some cases, the temperature and pressure within the extraction vessel are controlled such that the carbon dioxide is supercritical. In other cases, the temperature and/or pressure may be sufficiently low that the carbon dioxide is not supercritical. In cases where the carbon dioxide is supercritical, the temperature in the extraction vessel may be at least about 31.1° C. and the pressure may be at least about 7.39 MPa. In cases where the carbon dioxide is not supercritical, the temperature in the extraction vessel may be at least about 20° C., in some cases between about 20-200° C., and/or the pressure may be near vacuum or higher (e.g., a few millibar or higher), in some cases between about 0-600 Bar.

The hydrogen-donor solvent may be water in many cases. Various examples and equations herein assume that the hydrogen-donor solvent is water. However, other hydrogen-donor solvents may also be used, including but not limited to, alcohols (e.g., n-butanol, isopropanol, ethanol, methanol, etc.), acids (e.g., formic acid, acetic acid, etc.), nitromethane, etc.

The lithium oxide in the solid reaction product may react with the carbon dioxide to form additional lithium carbonate, as shown in Equation 8. As an example, the lithium oxide may react with the hydrogen-donor solvent to form lithium hydroxide, as shown in Equation 9. The lithium hydroxide may react with carbon dioxide to form additional lithium carbonate and regenerate the hydrogen-donor solvent, as shown in Equation 10. Equations 9 and 10 together simplify to Equation 8. The lithium carbonate reacts with the carbon dioxide and the hydrogen-donor solvent to form aqueous lithium bicarbonate, as shown in Equation 11.

$$Li_2O_{(aq)}+CO_{2(g)}\leftrightarrow Li_2CO_{3(aq)}$$ Equation 8:

$$Li_2O_{(aq)}+H_2O_{(l)}\leftrightarrow 2LiOH_{(aq)}$$ Equation 9:

$$2LiOH_{(aq)}+CO_{2(g)}\leftrightarrow Li_2CO_{3(aq)}+H_2O_{(l)}$$ Equation 10:

$$Li_2CO_{3(aq)}+CO_{2(g)}+H_2O_{(l)}\leftrightarrow 2LiHCO_{3(aq)}$$ Equation 11:

While Equations 8, 10, and 11 show the carbon dioxide as gaseous, it is understood that in some cases the carbon dioxide may supercritical, and in other cases the carbon dioxide may not be supercritical (e.g., gas or liquid), as mentioned above.

As supercritical carbon dioxide passes through the extraction vessel, its reduced viscosity and surface tension allow it to penetrate deep into the particles of the solid reaction product, where it reacts with the lithium oxide and lithium carbonate to form aqueous lithium bicarbonate, and leaving behind purified solid carbon.

Lithium carbonate exhibits low solubility in water relative to other lithium salts (e.g., about 0.69 g/100 mL at 100° C.); however, under mild pressure from carbon dioxide, the solubility of the lithium-containing compound increases more than ten-fold (e.g., about 19.1 g/100 mL at 100° C.) due to the formation of metastable lithium bicarbonate, as shown in Equation 11. This facilitates the extraction of lithium (as well as oxygen and non-elemental carbon) from the solid carbon.

The reactions in the extraction vessel proceed until the solid carbon reaches a target composition (at which point it is purified solid carbon). Because the extraction vessel is used to separate the lithium from the carbon, the target composition typically relates to a target lithium composition. In one example, the target lithium composition is no greater than about 0.1 atomic % lithium. In another example, the target lithium composition is no greater than about 0.05 atomic % lithium. In similar cases, the target composition may relate to a target carbon composition. In one example, the target carbon composition is at least about 99.9 atomic % carbon. In another example, the target carbon composition is at least about 99.95 atomic % carbon. Due to the possible presence of impurities, the target lithium composition may be more useful than the target carbon composition for determining when the purification process is sufficiently complete.

Within the extraction vessel, a mixture forms as the solid reaction product is treated to form purified solid carbon. The mixture includes the purified solid carbon in a solution of hydrogen-donor solvent, carbon dioxide, and lithium bicarbonate. The mixture can be filtered, decanted, etc. to separate the purified solid carbon from the solution of hydrogen-donor solvent, carbon dioxide, and lithium bicarbonate. At this point, the purified solid carbon may be dried and used to fabricate a device or material as described herein. Advantageously, a number of the reactions in the extraction vessel consume carbon dioxide.

With reference to FIGS. 2A and 2B, described further below, the reactions in Equations 8-11 may occur in the extraction vessel 208.

6. Reaction in Evaporation Reactor

The solution of hydrogen-donor solvent, carbon dioxide, and lithium bicarbonate obtained from the extraction vessel is provided to an evaporation reactor. The evaporation reactor may be a vacuum evaporation reactor. In the evaporation reactor, the pressure of the carbon dioxide is reduced to atmospheric pressure. As a result, the lithium bicarbonate in the solution reverts to solid lithium carbonate, regenerating the hydrogen-donor solvent and carbon dioxide, as shown in Equation 12:

$$2LiHCO_{3(aq)}\leftrightarrow Li_2CO_{3(s)}+CO_{2(g)}+H_2O_{(l)}$$ Equation 12:

Although Equation 12 results in the release of carbon dioxide, the amount of carbon dioxide released is less than the amount of carbon dioxide consumed in the extraction vessel, at least because of the carbon dioxide that is consumed when regenerating lithium carbonate from lithium oxide and/or lithium hydroxide.

The lithium carbonate is in aqueous phase in the extraction vessel, and solid phase in the evaporation reactor. The phase change results from the reduction in pressure as the carbon dioxide is evaporated from the solution in the evaporation reactor. The carbon dioxide can be recovered as it evaporates from the solution. The recovered carbon dioxide can be recycled to the extraction vessel and/or to the precipitation reactor. With reference to FIGS. 2A and 2B, described further below, the recovered carbon dioxide can be recycled to extraction vessel 208 and/or to precipitation reactor 212. The hydrogen-donor solvent can also be recovered, either as it evaporates from the solution (leaving recovered lithium carbonate), or after it is separated from the recovered lithium carbonate (e.g., through filtering, decanting, etc.). The recovered hydrogen-donor solvent can be recycled into the washer and/or into the extraction vessel. The recovered carbon dioxide and hydrogen-donor solvent can also be vented, if desired. With reference to FIGS. 2A and 2B, further described below, the recovered hydrogen-donor solvent can be recycled into washer 206 or extraction vessel 208. The reaction shown in Equation 12 may occur in evaporation reactor 210.

III. Reaction Product from the Electrolysis Reactor

The material that leaves the electrolysis reactor includes a mixture of solid carbon, lithium oxide, and unreacted lithium carbonate. When leaving the electrolysis reactor, the lithium carbonate is typically in molten form, with particles of solid carbon and solid lithium oxide distributed therein. This mixture of materials is referred to as the reaction product. The reaction product is cooled to form a solid reaction product. The lithium carbonate in the reaction product solidifies as it cools. The result is a solid block of reaction product, only about 15 wt % of which is solid carbon.

As mentioned above, the solid reaction product may have a composition (before any washing) that includes between about 5-50 wt % solid carbon, between about 5-50 wt % lithium oxide, and between about 5-50 wt % lithium carbonate. In cases where the solid reaction product is washed, it may have a composition (after washing) that includes between about 50-100 wt % solid carbon, between about 0-30 wt % lithium oxide, and between about 0-30 wt % lithium carbonate.

The reactions in the electrolysis reactor may be controlled to produce solid carbon material having a desired set of properties. For some applications, a highly or moderately crystalline graphite is desirable. Graphite crystallinity is typically measured in terms of the crystallite height, which is effectively a measure of the number of graphene sheets stacked on one another in a crystallite. In other words, it is a measure of the z-direction height of a crystallite—assuming that the x and y directions are in the plane of a graphene sheet. Naturally occurring graphite has a crystallite height of approximately 200 to 300 nanometers. Commonly produced synthetic graphite has a crystallite height of approximately 10 to 180 nanometers. The crystallite height produced using methods described herein may have a height of about 50 to 500 nanometers, depending on the desired use of the graphite. In some cases, a highly crystalline form of graphite—one resembling naturally occurring graphite—is produced. In such cases, the crystalline height may be about 150 to 300 nanometers.

To control crystallinity, one may design the electrolysis reactor to control the electrochemical deposition conditions at the cathode, the rate or frequency at which graphite is removed from the cathode, and/or the surface conditions of the cathode and/or anode. Methods for controlling the deposition conditions are further described in U.S. Pat. No. 9,290,853, titled "ELECTROLYTIC GENERATION OF GRAPHITE," which is herein incorporated by reference in its entirety.

In certain embodiments, the surface of the cathode is designed to provide a morphological "template" promoting a desired level of crystallinity. In some embodiments, the cathode surface contains a carbide to act as a template. Example carbides include, but are not limited to, titanium carbide, iron carbide, chromium carbide, manganese carbide, silicon carbide, nickel carbide, and molybdenum carbide. The species of carbide chosen for a certain application may depend on various factors including the desired qualities of the graphite and the properties of the cathode itself. In some embodiments, the cathode surface contains graphite. The carbide, graphite, or other "template" surface may be provided as a thin continuous layer, a discontinuous layer, or as a monolithic structure that sometimes comprises the entire electrode. In certain embodiments where a thin layer is used, the layer has a thickness of about 1 to 500 nanometers. The thin layer is provided on an appropriately electrically conductive substrate such as stainless steel or titanium.

In certain embodiments, the cathode and/or anode are porous. In such embodiments, the electrode may have a porosity of between about 0 and 0.7 for example. Porous electrodes have a relatively high surface area per unit volume, thereby promoting relatively high mass deposition rates within the electrochemical cell (as compared to non-porous electrodes). In certain embodiments, the electrode surface is made relatively rough. A rough electrode surface provides nucleation sites (protrusions) to facilitate initiation of the graphite deposition reaction and facilitate uniform deposition over the electrode surface. In some implementations, the surface roughness (Ra) is between about 10 and 1000 micrometers. Generally speaking, many different types of electrodes may be used, as described further below.

The carbon or graphite particles or flakes present in the electrolyte (and separated therefrom) typically have a principal dimension (longest linear dimension) of about 0.1 to 1000 micrometers. The principal dimension is the particle diameter, assuming generally spherical particles.

While certain embodiments described herein have focused on deposition of graphitic carbon, other solid carbon reaction products besides graphite may be produced in various embodiments. For example, other forms of elemental carbon such as carbon black, graphene, amorphous carbon, activated carbons, carbon nanotubes, and fullerenes may be produced.

IV. Electrolyte in the Electrolysis Reactor

The electrolyte is typically a molten salt such as an alkali metal carbonate. Lithium carbonate is one example. Other examples include sodium carbonate and potassium carbonate. Some electrolytes are made from mixtures of two or more of these carbonates. In some cases, the electrolyte contains between about 30 and 75% by mass lithium carbonate. In one example, the electrolyte contains about 40 to 60% by mass lithium carbonate. Other electrolyte components may include conductivity enhancing additives such as metal chlorides. Example metal chlorides include, but are not limited to, lithium chloride, sodium chloride and potassium chloride. The metal chlorides may also be helpful in controlling the melting point of the electrolyte. In alternative embodiments, the electrolyte is an ionic liquid. Example ionic liquids include, but are not limited to, 1-Ethyl-3-methylimidazolium tetrafluoroborate (EMIM-$BF_4$) and counter-anion derivatives thereof, $PF_6$, halides, pseudohalides, and alkyl substituted imidazolium salts. Although certain ionic liquids may be functionally appropriate for use as the electrolyte, their use may be limited by other considerations such as cost.

The electrolyte should remain in a molten liquid state. Because typical electrolyte materials (e.g., alkali metal carbonates) are solid at room temperature, a relatively high temperature should be employed, although typically below about 900° C. In certain embodiments, an electrolyte temperature of about 450° C. to 900° C. is maintained. In other embodiments, an electrolyte temperature of about 500° C. to 750° C. is maintained. The temperature should not be so high that it aggressively degrades the components of the reactor, including the electrodes.

In certain embodiments where a carbonate-based electrolyte is used, the electrolyte has a viscosity between about 20 and 300 centipoise without taking into account the presence of carbon particles in the electrolyte. In certain embodiments, the electrolyte viscosity is between about 20-100 centipoise. The viscosity of the molten carbonate/solid carbon slurry may be between about 30-1000 centipoise in certain embodiments. The viscosity of the molten carbonate/solid carbon slurry will depend on, among other factors, the amount of solid carbon present in the slurry.

In many embodiments, the flow of electrolyte at the surface of the electrode is laminar during deposition. In other implementations, the flow of electrolyte is laminar during a substantial portion of the deposition process, and a turbulent electrolyte flow is used periodically to facilitate removal of the electrodeposited carbon. For instance, the flow rate of electrolyte may be periodically increased to produce a turbulent flow in which the shear stress of the fluid passing over the electrodeposited carbon has sufficient force to dislodge the carbon from the surface of the electrode. Turbulent flow may be introduced after a period of time has passed or at a particular frequency, or after the deposited carbon reaches a certain thickness.

Under typical conditions, carbon begins depositing within the first few minutes of the reaction, and the crystalline quality of the carbon (e.g., graphite in many cases) improves as more carbon is deposited. As such, in certain implementations it is beneficial to allow the deposition to continue for relatively long periods of time (e.g., more than 30 minutes, more than 1 hour, more than 2 hours, or even longer in certain implementations) before the material is actively removed from the cathode surface.

V. Energy Consumption

1. Electrical Energy and Power to the Electrodes to Drive the Reactions in the Electrolysis Reactor The electrode and cell voltages are dictated by the thermodynamics, mass transport, and kinetics of the electrode reactions. Higher deposition rates tend to drive the electrode potential further apart. The electrical current employed in the reactor is a function of the rate of solid carbon generation. In various implementations, the electrical energy requirements for the electrolysis reactor are comparable to those used for aluminum smelting reactors.

Any readily available source of electrical energy may be employed to power the electrochemical reactions. Electrical energy supplied from a municipal grid or from a local, sometimes dedicated, source may be employed. In certain embodiments, a fuel-cell is employed as a source of electrical energy to drive the electrochemical reaction of carbon oxide and/or carbonate to carbon. As is understood by those of skill in the art, a fuel cell will require a source of hydrogen. The hydrogen may be provided from a source of molecular hydrogen or from a hydrocarbon or other organic compound that is reformed at the fuel cell to produce hydrogen locally.

2. Heat Energy to Maintain Desired Temperature in Electrolysis Reactor, Precipitation Reactor, Extraction Vessel, and Evaporation Reactor Heat energy must be supplied to maintain the electrolyte in a suitable state, e.g., a molten state, within the electrolysis reactor. Heat energy may also supplied to the extraction vessel to achieve supercritical carbon dioxide. However, carbon dioxide only needs to reach about 31.1° C. to become supercritical, and in some cases the extraction vessel is not heated. Similarly, heat energy may be supplied to the precipitation reactor to establish a desired temperature (e.g., an elevated temperature may be used in the precipitation reactor to decrease the solubility of lithium carbonate, thereby increasing precipitation), and/or to the evaporation reactor to help evaporate carbon dioxide and/or hydrogen-donor solvent. However, these evaporation processes can also be done without added heat, e.g., by applying vacuum conditions to achieve a low pressure and/or by waiting a sufficient amount of time for the carbon dioxide and/or hydrogen-donor solvent to evaporate out from the solution. One or more joule heater, heat exchanger, or other temperature control mechanism may be provided to heat the electrolysis reactor, extraction vessel, and/or evaporation reactor, as needed.

In certain embodiments, heat energy is derived from the local environment, particularly if a combustion reaction is being used to generate the carbon dioxide. The heat content of the combustion gases may be extracted to a degree to help power the reaction in the electrolysis reactor and/or in the extraction vessel. In some implementations, heat energy (to maintain the electrolyte in a molten state, for example) is provided by coupling through heat exchange of existing industrial processes.

3. Electrical Energy in Grinder

A grinder may be provided to grind the solid reaction product into a powdered form before it is delivered to the washer and/or extraction vessel. In order to drive the mechanical components of the grinder, electrical energy is provided. The electrical energy may come from any of the sources listed above.

4. Electrical Energy in Washer

A washer may be provided to wash the solid reaction product before it is delivered to the extraction vessel. In some cases, the washer requires no electrical input. In other cases, the washer may include mechanical components (e.g., a stirrer, inlet and outlet valves, pumps, etc.) that are driven by electrical energy. The electrical energy may come from any of the sources listed above.

5. Electrical Energy in the Extraction Vessel

In some cases, the extraction vessel may require no electrical energy input. In some other cases, electrical energy may be provided to drive one or more mechanical components (e.g., pump, valves, etc.) in the extraction vessel. The electrical energy may come from any of the sources listed above. As mentioned above, heat energy may be provided to the extraction vessel to maintain the extraction vessel at a desired temperature.

6. Electrical Energy in Evaporation Reactor

In some cases, the evaporation reactor may require no energy input. In such cases, carbon dioxide and/or hydrogen-donor solvent may evaporate out from the solution if given sufficient time. In order to speed up this process, vacuum may be applied and/or the temperature may be raised. Energy for applying vacuum and/or raising the temperature in the evaporation reactor may be provided from any available source.

7. Electrical Energy in Precipitation Reactor

In some cases, the precipitation reactor may require no electrical energy input. In some cases, electrical energy may be provided to drive one or more mechanical components of the precipitation reactor (e.g., pumps, valves, stirrers, etc.). As mentioned above, heat energy may be provided to the precipitation reactor, for example to decrease the solubility of lithium carbonate, thereby maximizing precipitation of the recovered lithium carbonate. The energy may be provided to the precipitation reactor from any available source.

VI. Timing

The techniques described herein may be implemented in a continuous mode, a semi-continuous mode, or a batch mode. In the continuous mode, several operations may take place simultaneously and continuously. For example, electroplating may occur without interruption during extended production of solid carbon material. In some cases, any two or more of the following operations occur continuously: reactant delivery to electrolysis chamber; electroplating in electrolysis chamber; scraping/material removal in electrolysis chamber; delivery of reaction product from electrolysis chamber to grinder, washer, or extraction vessel; grinding of solid reaction product in the grinder; washing of solid reaction product in washer; delivery of lithium hydroxide to precipitation reactor; reaction of lithium hydroxide with carbon dioxide to form recovered lithium carbonate in the precipitation reactor; delivery of recovered lithium carbonate to the electrolysis reactor; delivery of solid reaction product from washer to extraction vessel; delivery of carbon dioxide and hydrogen-donor solvent to the extraction vessel; removal of purified carbon from mixture of purified carbon and solution of carbon dioxide/hydrogen-donor solvent/lithium bicarbonate; delivery of mixture or solution from extraction vessel to evaporation reactor; removal of carbon dioxide from the solution in the evaporation reactor; removal of hydrogen-donor solvent from the solution in the evaporation reactor; delivery of recovered lithium carbonate from the evaporation reactor to the electrolysis reactor; delivery of recovered carbon dioxide and/or hydrogen-donor solvent from the evaporation reactor to the extraction vessel, washer, or the precipitation reactor; delivery of recovered water from precipitation reactor to the washer or to the extraction vessel.

The mode of operation may be viewed from the perspective of a single cathode in, e.g., a multi-cathode system. In the semi-continuous mode, some or all of these operations may temporarily cease at some point during processing and then resume. As an example, electrolytic reduction at a cathode may temporarily cease while graphitic material is scraped from the cathode surface. In the batch mode, many of the operations occur sequentially and are performed on a specific batch of materials. Even where batch processing is used, various materials may be recycled and used in future batches, as explained in relation to FIGS. 2A and 2B, for example.

In the continuous mode of operation, reactants are constantly provided to the electrodes of the electrolysis reactor and other relevant apparatus, and reaction products are constantly and continuously separated out as described herein. Power is continuously supplied to the electrode(s) of the electrolysis reactor such that electroplating happens continuously. Further, the removal of the electroplated material from the electrode(s) happens continuously. A particularly suitable removal mechanism in this case may be a scraper that is maintained at a fixed distance away from a rotating cathode, though other methods may be employed as well.

The semi-continuous mode of operation affords more flexibility compared to the continuous mode. In this implementation, there is generally a continuous supply of reactants, but some of the processes described above may temporarily cease during processing. For example, electroplating on a cathode may cease while electroplated material is removed from the electrode. In embodiments where there are multiple pairs of electrodes, electroplating on a first cathode may continue while electroplating on a second cathode temporarily ceases in order to remove material from the second cathode. In some implementations, electroplating is always taking place on at least one cathode of a multi-cathode system. While electroplating on one cathode is temporarily suspended during scraping/material removal, it continues on one or more other cathodes that are not being scraped or otherwise having material removed. In this way, graphitic material may be sequentially removed from individual electrodes. From the perspective of the reactor as a whole, this embodiment may be considered to use continuous electroplating. From the perspective of an individual cathode, this embodiment may be considered as semi-continuous electroplating. Similarly, where semi-continuous operation is used, one or more apparatus (e.g., electrolysis reactor, evaporation reactor, extraction vessel, grinder, washer, etc.) may operate continuously while others do not.

In the batch mode of operation, delivery of reactants does not occur continuously. Instead, the reactants are generally introduced into each relevant apparatus and allowed to react for a certain period of time. Although the electrolyte and other components may be recycled through an appropriate recirculation/separation loop, no new reactants are provided to a particular apparatus after the initial set of reactants is introduced to the apparatus. Each apparatus in the system may run continuously, semi-continuously, or in batches.

VII. Process Flow Example

FIG. 1 presents a flowchart for a method 100 of producing and purifying solid carbon. The method begins at operation 102, where a reaction is performed in an electrolysis reactor to form a solid reaction product by reducing carbonate ions in molten carbonate salt electrolyte. The reactions that occur in the electrolysis reactor are described in Equations 1-4. Equation 5 may also occur in the electrolysis reactor if carbon dioxide is fed to the electrolysis reactor. The reaction product that leaves the electrolysis reactor is typically molten, but it forms a solid reaction product as it cools. At operation 104, the solid reaction product is grinded into a powder form. The powdered form of the reaction product may be referred to as the powdered reaction product.

At operation 106, the powdered reaction product is transferred to an extraction vessel. Also at operation 106, a hydrogen-donor solvent is delivered to the extraction vessel. At operation 108, carbon dioxide is added to the extraction vessel until the pressure in the extraction vessel reaches a target pressure, $P_{target}$. The carbon dioxide may be supercritical at the target pressure. At operation 110, the carbon dioxide and hydrogen-donor solvent are maintained in the extraction vessel until the powdered reaction product reaches a target lithium content. This forms a mixture of purified carbon-based powder (often referred to as purified solid carbon) in a solution of lithium bicarbonate, carbon dioxide, and hydrogen-donor solvent within the extraction vessel. The reactions that occur in the extraction vessel are described in Equations 8-11. At operation 112, the purified carbon-based powder is separated from the mixture, leaving the solution of lithium bicarbonate, carbon dioxide, and hydrogen-donor solvent. This separation can be done by filtering, decanting, etc. At operation 114, the purified carbon-based powder is dried and then used for a desired application (e.g., to fabricate a device or material as described herein). The purified carbon-based powder may also be sold at this point.

At operation 116, the solution of lithium bicarbonate, carbon dioxide, and hydrogen-donor solvent is transferred to an evaporator (often referred to as an evaporation reactor). The carbon dioxide is allowed to vent out of the solution, which precipitates lithium carbonate. The lithium carbonate forms from the lithium bicarbonate that was in the solution. This forms a slurry of lithium carbonate in hydrogen-donor solvent in the evaporator. The reaction that occurs in the evaporator is described in Equation 12. The carbon dioxide that vents out of the solution can be recovered and recycled. In some cases, the carbon dioxide recovered from the evaporator is recycled to the extraction vessel. In these or other cases, the carbon dioxide recovered from the evaporator is recycled to a precipitation reactor. In these or other cases, the carbon dioxide recovered from the evaporator is recycled to the electrolysis reactor. While FIG. 1 only suggests recycling the carbon dioxide into the extraction vessel, it is understood that this carbon dioxide may be recycled into any apparatus of the system that uses carbon dioxide as a reactant.

At operation 120, excess hydrogen-donor solvent is removed from the slurry, leaving behind recovered lithium carbonate. The excess hydrogen-donor solvent may be removed through evaporation, filtering, decanting, etc. The excess hydrogen-donor solvent which is removed from the slurry may be recycled to the extraction vessel, as shown in operation 122. Similarly, the excess hydrogen-donor solvent removed from the slurry may be recycled to a washer, in cases where the powdered reaction product is washed before it is delivered to the extraction vessel. The recovered lithium carbonate may then be recycled to the electrolysis reactor, as shown in operation 124.

Certain operations in method 100 are shown in boxes with a dotted line. These operations are understood to be optional. Similarly, in various embodiments certain additional steps may be taken which are not described in method 100. Such additional steps include, but are not limited to, washing the powdered reaction product in a washer after operation 104 and before operation 106 (according to Equation 6), providing lithium hydroxide from the washer to a precipitation reactor, reacting the carbon dioxide with the lithium hydroxide in the precipitation reactor to form recovered lithium carbonate and recovered water (according to Equation 7), and recycling the recovered lithium carbonate generated from the lithium hydroxide and carbon dioxide to the electrolysis reactor. These operations are further described with relation to FIG. 2B, described further below.

VIII. Apparatus—Reactor Design

1. Overall System Design

The principal system components include an electrolysis reactor, an extraction vessel, and an evaporation reactor. Various additional components may be provided including, but not limited to, a grinder, a washer, a precipitation reactor for regenerating lithium carbonate from lithium hydroxide and carbon dioxide, as well as piping, pumps, and any other components needed to deliver materials to the various components, as needed.

FIG. 2A illustrates one embodiment of a system configured to produce and purify solid carbon as described herein. The system includes an electrolysis reactor 202, a grinder 204, an extraction vessel 208, and an evaporation reactor 210. The electrolysis reactor 202 receives a feed of lithium carbonate. In the embodiment of FIG. 2A, the lithium carbonate fed to the electrolysis reactor 202 is lithium carbonate that is recovered and recycled from the evaporation reactor 210, as described further below.

Within the electrolysis reactor 202, several reactions take place. For instance, the reactions shown in Equations 1-3 take place at the cathode, and the reaction in Equation 4 (and in some cases Equation 5, if carbon dioxide is provided to the electrolysis reactor) takes place at the anode.

$$Li_2CO_{3(l)} \leftrightarrow 2Li^+_{(aq)} + CO_3^{2-}{}_{(aq)} \quad \text{Equation 1:}$$

$$CO_3^{2-}{}_{(aq)} + 4e^- \leftrightarrow C_{(s)} + 3O^{2-}{}_{(aq)} \quad \text{Equation 2:}$$

$$2Li^+_{(aq)} + O^{2-}{}_{(aq)} \leftrightarrow Li_2O_{(s)} \quad \text{Equation 3:}$$

$$2O^{2-}{}_{(aq)} \leftrightarrow O_{2(g)} + 4e^- \quad \text{Equation 4:}$$

$$CO_{2(g)} + O^{2-}{}_{(aq)} \leftrightarrow CO_3^{2-}{}_{(aq)} \quad \text{Equation 5:}$$

These equations are identical to Equations 1-5 listed above. The oxygen produced at the anode vents out of the molten materials and may be released or captured as desired. The reaction product that leaves the electrolysis reactor 202 includes a mixture of solid carbon and lithium oxide in molten lithium carbonate. The molten lithium carbonate is unreacted electrolyte. This mixture is cooled to form a solid block of reaction product, which is fed to the grinder 204. The grinder 204 grinds the solid reaction product into a powdered form, so that the solid carbon can be purified more easily.

The powdered solid reaction product is then fed to the extraction vessel 208. Carbon dioxide and a hydrogen-donor solvent are also supplied to the extraction vessel 208. The carbon dioxide is supercritical in many cases. In FIG. 2A, the carbon dioxide is fed to the extraction vessel 208 from a feedstock of carbon dioxide (e.g., fresh carbon dioxide that is not recycled from another component of the system), and optionally from a stream of recovered carbon dioxide that originates from the evaporation reactor 210. The hydrogen-donor solvent is supplied to the extraction vessel 208 from a stream of recovered hydrogen-donor solvent from the evaporation reactor 210. Within the extraction vessel 208, the reactions in Equations 8-11 take place.

$$Li_2O_{(aq)} + CO_{2(g)} \leftrightarrow Li_2CO_{3(aq)} \quad \text{Equation 8:}$$

$$Li_2O_{(aq)} + H_2O_{(l)} \leftrightarrow 2LiOH_{(aq)} \quad \text{Equation 9:}$$

$$2LiOH_{(aq)} + CO_{2(g)} \leftrightarrow Li_2CO_{3(aq)} + H_2O_{(l)} \quad \text{Equation 10:}$$

$$Li_2CO_{3(aq)}+CO_{2(g)}+H_2O_{(l)}\leftrightarrow 2LiHCO_{3(aq)}$$ Equation 11:

These equations are identical to Equations 8-11 listed above. Generally speaking, the reactions that take place in the extraction vessel 208 change the lithium-containing components from solid form (where they are mixed with the solid carbon) to liquid form (where they can be phase separated from the solid carbon). In addition, the reactions that take place in the extraction vessel 208 operate to regenerate the lithium carbonate electrolyte from lithium oxide and carbon dioxide. This regeneration of electrolyte reduces the cost of producing the solid carbon, since the regenerated lithium carbonate can be recycled to the electrolysis reactor 202 to reduce material costs. The lithium carbonate regeneration process is also advantageous in that it consumes carbon dioxide. Much of the regenerated lithium carbonate is in the form of lithium bicarbonate within the extraction vessel 208, and it reverts to lithium carbonate when provided to the evaporation reactor 210.

The carbon dioxide, hydrogen-donor solvent, and solid reaction product are maintained within the extraction vessel 208 until the solid carbon reaches a target composition, at which point it is purified solid carbon. The purified solid carbon is in a mixture with a solution of the carbon dioxide, hydrogen-donor solvent, and lithium bicarbonate. These materials may be removed from the extraction vessel 208 in either one stream or two streams. Where only a single stream is used, it includes the mixture of the purified solid carbon and the solution of carbon dioxide, hydrogen-donor solvent, and lithium bicarbonate. The purified solid carbon can be separated from the mixture by filtering, decanting, or any other liquid-solid separation techniques. Where two streams leave the extraction vessel 208, one stream includes the purified solid carbon and another stream includes the solution of carbon dioxide, hydrogen-donor solvent, and lithium bicarbonate. In this case, the purified solid carbon is separated from the solution within the extraction vessel 208 (e.g., by filtering, decanting, or any other liquid-solid separation techniques). The purified solid carbon is typically dried after it is removed from the extraction vessel 208. The purified solid carbon can then be sold or used to fabricate a device or material as described above.

The solution of carbon dioxide, hydrogen-donor solvent, and lithium bicarbonate is then fed to the evaporation reactor 210. In the evaporation reactor 210, the pressure of the carbon dioxide is lowered so that it is no longer supercritical. In many cases, the pressure is lowered to atmospheric pressure or even lower. As the pressure is reduced, carbon dioxide vents out of the solution, and lithium bicarbonate reverts to recovered lithium carbonate, forming a slurry of recovered lithium carbonate in recovered hydrogen-donor solvent. This reaction is shown in Equation 12.

$$2LiHCO_{3(aq)}\leftrightarrow Li_2CO_{3(s)}+CO_{2(g)}+H_2O_{(l)}$$ Equation 12:

This reaction is identical to Equation 12, listed above.

The vented carbon dioxide can be recovered and recycled. In FIG. 2A, the carbon dioxide that vents out of the evaporation reactor 210 is recovered and recycled to the extraction vessel 208. Similarly, the hydrogen-donor solvent can be recovered and recycled. In FIG. 2A, the hydrogen-donor solvent is recovered from the evaporation reactor 210 and recycled to the extraction vessel 208. Depending on the operating conditions employed in the evaporation reactor 210, the recovered hydrogen-donor solvent may (to some extent) be in gaseous form, mixed with the recovered carbon dioxide. Much of the recovered hydrogen-donor solvent is present in liquid form, and can be separated from the recovered lithium carbonate through liquid-solid separation methods such as filtering, decanting, etc. The recovered lithium carbonate can be sold or recycled to the electrolysis reactor 202.

FIG. 2B illustrates another embodiment of a system configured to produce and purify solid carbon as described herein. As compared to the system in FIG. 2A, the system of FIG. 2B includes certain additional components including a washer 206 and a reactor 212, as well as additional recycling loops for routing/reusing certain materials. For the sake of brevity, only the differences will be discussed. In the embodiment of FIG. 2B, the materials that leave the grinder (e.g., the solid reaction product in powdered form) are provided to washer 206 before they are delivered to the extraction vessel 208. Within the washer 206, the solid reaction product is washed with water. The water reacts with some portion of the lithium oxide in the solid reaction product to form lithium hydroxide, which is aqueous. This reaction is shown in Equation 6.

$$Li_2O_{(s)}+H_2O_{(l)}\leftrightarrow 2LiOH_{(aq)}$$ Equation 6:

This reaction is identical to Equation 6, listed above. The liquid phase in the washer 206 includes a substantial amount of lithium hydroxide, and may also include water. The solid phase in the washer 206 includes the solid carbon, lithium oxide, and lithium carbonate. The amount of lithium oxide leaving the washer 206 is less than the amount of lithium oxide entering the washer 206, due to the reaction of some of the lithium oxide with the water to form lithium hydroxide. However, some amount of lithium oxide is typically still trapped in the solid reaction product, even after washing. The liquid phase and solid phase in the washer are separated by filtering, decanting, or any other available liquid-solid separation technique. This separation may be done in the washer 206, after the materials leave the washer 206, or some combination thereof. In some cases, the liquid phase from the washer (which includes a substantial amount of lithium hydroxide) is sold after it is removed from the washer. Due to the demand for lithium-containing materials, lithium hydroxide is a reasonably valuable. In some other cases, the liquid phase from the washer is fed to a reactor 212. A feedstock of carbon dioxide may also be fed to the reactor 212, where it reacts with the lithium hydroxide to form recovered lithium carbonate, as shown in Equation 7.

$$2LiOH_{(aq)}+CO_{2(g)}\leftrightarrow Li_2CO_{3(s)}+H_2O_{(l)}$$ Equation 7:

This reaction is identical to Equation 7, listed above. The recovered lithium carbonate from reactor 212 can be sold or recycled to the electrolysis reactor 202. The reaction in reactor 212 also forms water. This water can be recovered and either vented or recycled. In cases where this water is recycled, it can be delivered to either the washer 206, or to the extraction vessel 208 (where it acts as a hydrogen-donor solvent). The remaining portions of FIG. 2B are the same as those in FIG. 2A.

Certain streams shown in FIGS. 2A and 2B are illustrated in dotted lines. These dotted lines indicate optional transfers of material that may or may not take place in particular embodiments. For example, the recovered lithium carbonate leaving evaporation reactor 210 may be recycled to the electrolysis reactor 202 in some cases, and in other cases it may be sold. Similarly, recovered water from reactor 212 may be vented, recycled to the washer 206, or recycled to the extraction vessel 208.

Although not shown in FIGS. 2A and 2B, in some cases a lithium carbonate feedstock (e.g., fresh lithium carbonate which is not recycled from another component of the system) may be provided to the electrolysis reactor 202. This lithium carbonate feedstock, where used, may be referred to as a makeup lithium carbonate feed, and the amount of lithium carbonate feedstock used may be selected to compensate for a difference between an amount of lithium carbonate leaving the electrolysis reactor 202 and an amount of recovered lithium carbonate being recycled to the electrolysis reactor 202. In some cases, a feedstock stream of hydrogen-donor solvent (e.g., fresh hydrogen-donor solvent that is not recycled from another component of the system) may be provided to the extraction vessel 208. This hydrogen-donor solvent feedstock, where used, may be referred to as a makeup hydrogen-donor feed, and the amount of hydrogen-donor solvent feedstock used may be selected to compensate for a difference between an amount of hydrogen-donor solvent leaving the extraction vessel 208, and an amount of hydrogen-donor solvent being recycled to the extraction vessel 208.

In certain cases, the hydrogen-donor solvent is efficiently recycled within the system, as described herein, and little or no fresh hydrogen-donor feedstock needs to be added to the extraction vessel 208. By contrast, although some amount of carbon dioxide may be recycled to the extraction vessel 208, a fresh feedstock of carbon dioxide is always provided to the extraction vessel. This fresh feedstock of carbon dioxide is needed due to the amount of carbon dioxide that is consumed in regenerating the lithium carbonate electrolyte.

Overall, the systems shown in FIGS. 2A and 2B consume carbon dioxide and produce solid carbon and gaseous oxygen. The other materials can be recycled as shown. The configurations shown in FIGS. 2A and 2B provide substantial improvements compared to systems where carbon dioxide is consumed producing solid carbon in an electrolysis reactor, where the carbon dioxide parasitically reacts with the solid carbon. Such parasitic reactions may occur as a result of the conditions inside the electrolysis reactor. By instead providing the carbon dioxide in one or more subsequent reactions to purify the solid carbon and/or recover lithium carbonate, the carbon dioxide is consumed more efficiently. Moreover, this process substantially reduces the cost of raw ingredients needed to run the electrolysis reactor 202. The purification process that separates the solid carbon from the lithium oxide and lithium carbonate regenerates additional lithium carbonate from the lithium oxide, and allows all of the lithium carbonate to be recycled to the electrolysis reactor to produce additional solid carbon.

Previous methods used in separating the solid carbon from the unreacted lithium carbonate electrolyte leaving the electrolysis reactor 202 have been unable to directly recover lithium carbonate. Such methods have generally relied on purification techniques such as thermal purification, thermochemical purification, or chemical purification. Inevitably, these methods create lithium compounds that cannot be used in the electrolysis process as a carbon source (e.g., lithium chloride, lithium fluoride, lithium sulfate, etc.) and must be disposed of, sold, or converted into lithium carbonate. The techniques herein provide substantial improvements related to improved recovery and recyclability of lithium carbonate, and reduced material costs.

2. The Electrolysis Reactor

Figure 3A:
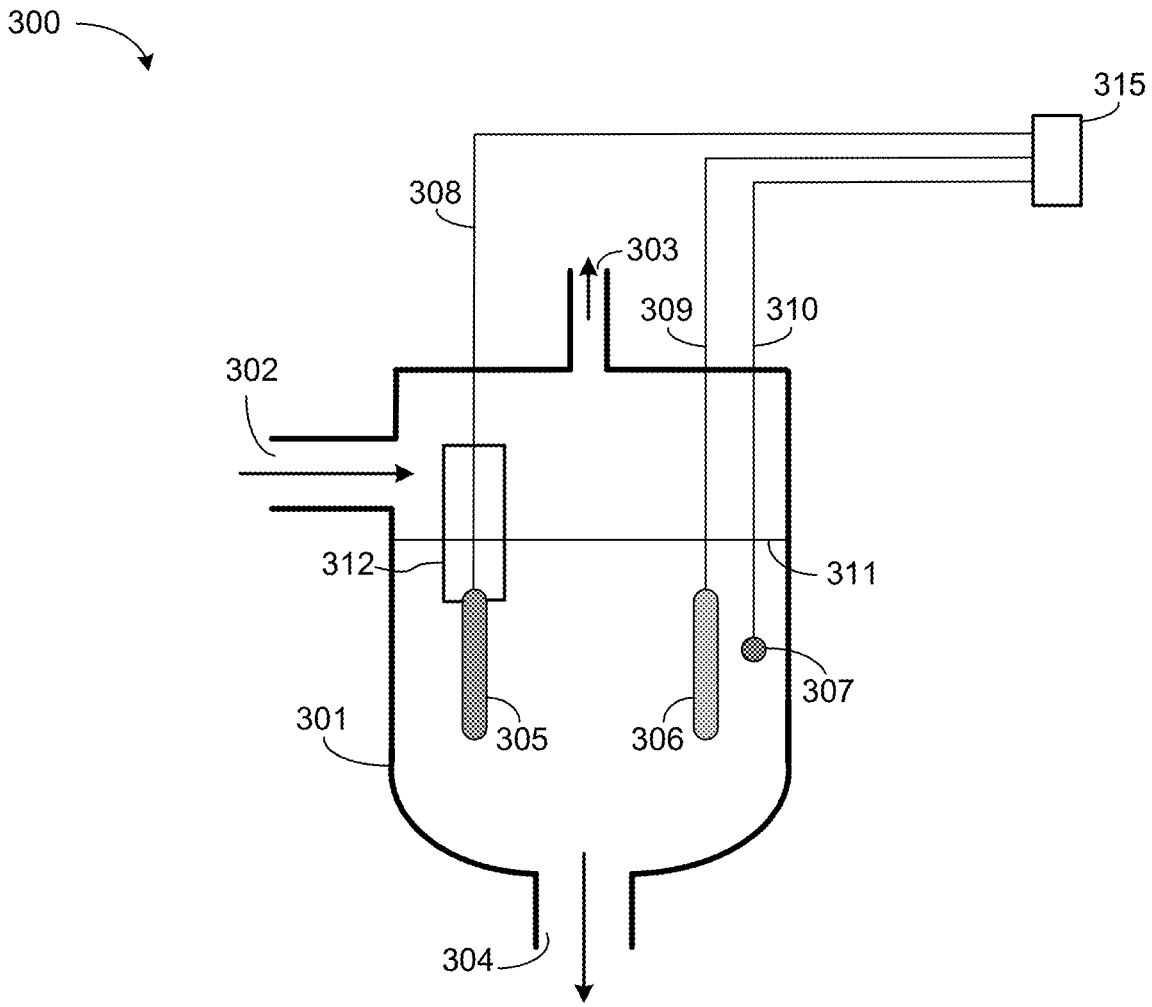
FIGS. 3A-3C, 3E and 3F illustrate an electrolysis reactor according to certain embodiments.

FIG. 3A shows one example of an electrolysis reactor 300 for producing carbon from molten carbonate salt electrolyte in accordance with the principles disclosed herein. In this implementation, the electrolysis reactor comprises a container 301, which may include multiple layers including an outer container, an inside bow, and insulation between the outer container and the inside bow. The inside bow may be made of any suitable material, including but not limited to ceramic. Molten carbonate salt electrolyte (e.g., lithium carbonate) is fed into the reactor at inlet 302. The electrolysis reactor 300 is filled with electrolyte up to the electrolyte fill line 311. Carbonate ions originating from the electrolyte, as described in Equation 1, are reduced at a cathode 305 to form solid carbon and soluble oxide anion, as described in Equation 2. Some amount of lithium oxide is also produced, as described in Equation 3. The oxide anion reacts at an anode 306 to form elemental oxygen, which may flow through an oxygen evolution pathway (not shown) and exits the reaction chamber at an outlet 303. One or more gauges 307 may be employed to monitor the temperature, pressure, or other conditions present in the electrolysis reactor 300. Electrical leads 308, 309, and 310 supply power to the cathode 305, anode 306, and gauge 307, respectively. In certain implementations, a motor (not shown) may be used, for example, to drive motion of one or more of the electrodes or other moving parts of the reactor.

In this example, after the solid carbon forms on the cathode 305, it is removed from the cathode 305 through the use of a carbon remover such as a scraper 312. In certain embodiments, solid carbon material is removed at an elevated temperature, such that the material has a lower shear modulus and therefore is easier to remove. In some cases the elevated temperature is between about 400-900° C., for example between about 600-800° C. The removed carbon then mixes with the electrolyte to form a slurry. The slurry passes through outlet 304. The slurry may be cooled to form a solid block of reaction product after it leaves outlet 304. A controller and power supply 315 provides the electrical leads 308-310 connected with the cathode 305, anode 306, gauge 307, and potentially to other components in the apparatus (e.g., a motor, a mixer, etc.). The controller and power supply 315 may be implemented as one unit or as separate units. The controller may be connected with various components in the apparatus, and can be designed or configured to monitor sensor outputs and control various aspects of the reaction. For example, the controller may control the amount of reactants (e.g., recycled lithium carbonate and/or fresh feedstock lithium carbonate) that are fed to the electrolysis reactor 300, the amount of current or voltage supplied to the anode 306 and/or cathode 305, the rate of removal of carbon, the power delivered to a pump, etc. The controller may be configured to control these and other variables in order to fine tune the reaction to obtain solid carbon with desired properties.

Figure 3B:
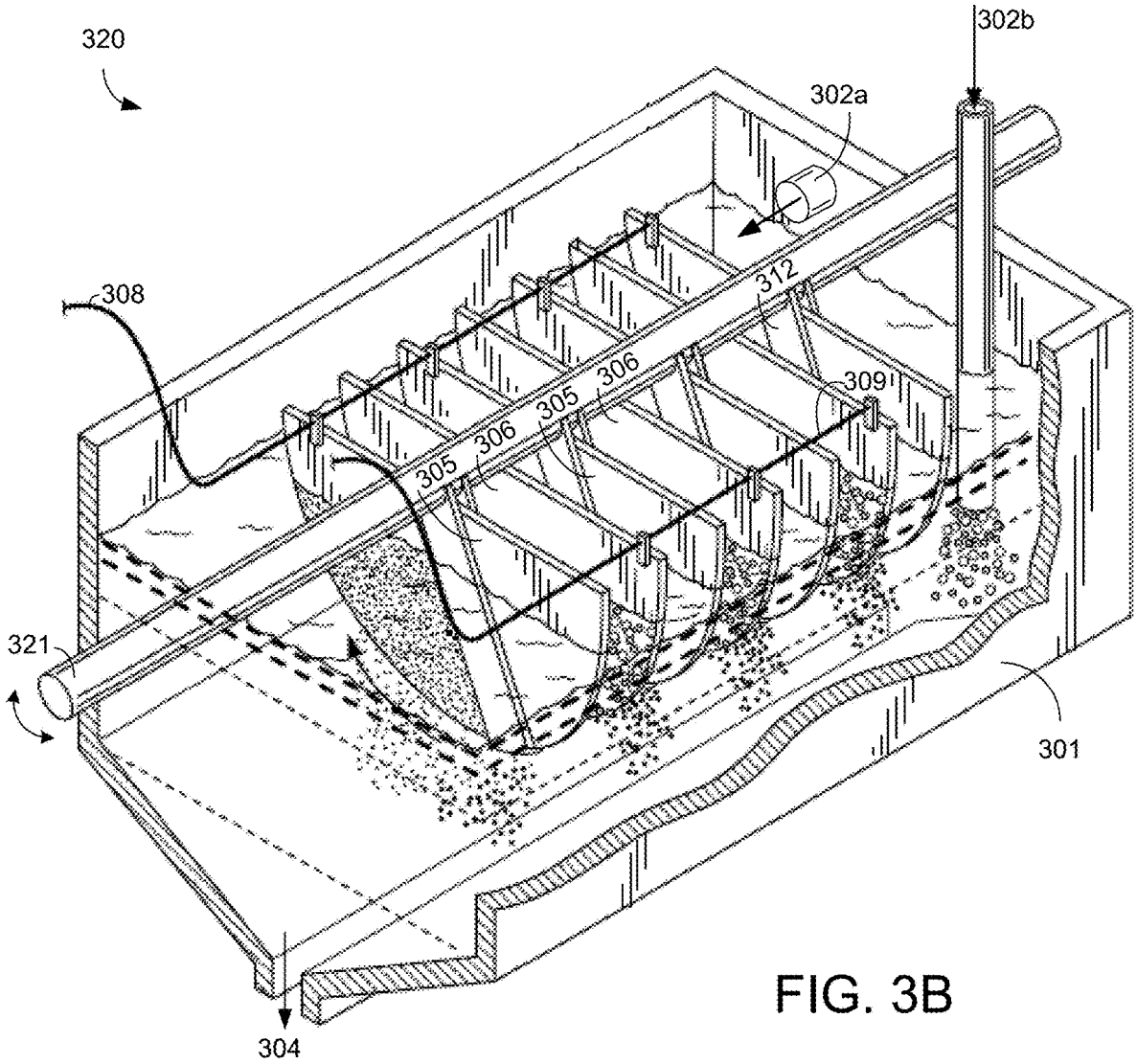
Figure 3C:
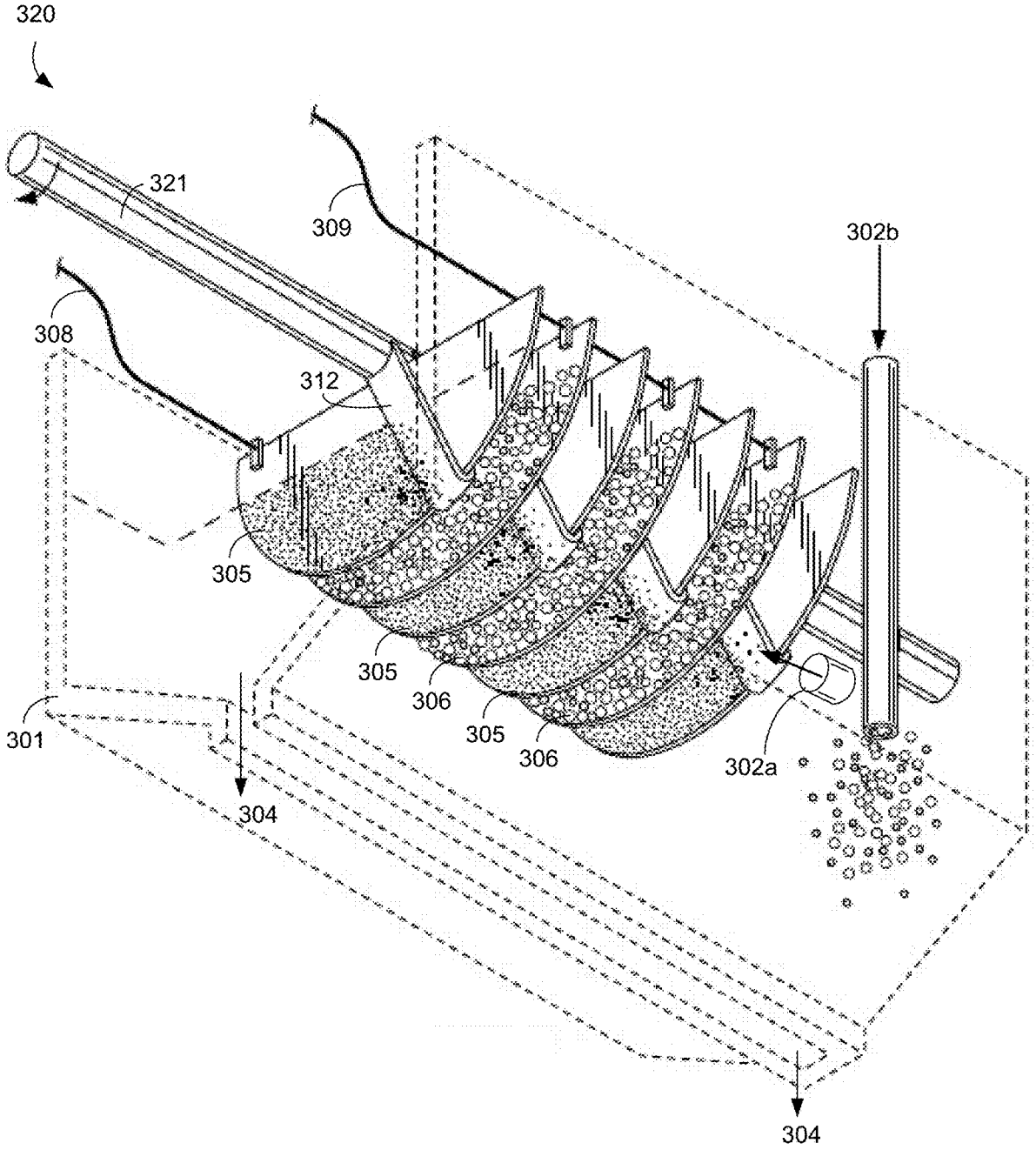

FIG. 3B illustrates another embodiment of an electrolysis reactor 320 that may be used in certain implementations. In this example the electrolysis reactor 320 includes multiple cathodes 305 and multiple anodes 306. Each of the cathodes 305 is electrically connected with electrical lead 308, and each of the anodes 306 is electrically connected with electrical lead 309. Molten carbonate salt electrolyte is delivered to the container 301 of the electrolysis reactor 320 through inlet 302*a*. Optionally, inlet 302*b* may be used to introduce carbon dioxide to the electrolysis reactor 320. However, in many cases inlet 302*b* is omitted. As solid carbon material builds up on the cathodes 305, it is scraped off with the scrapers 312. The scrapers 312 may move back and forth, or may rotate in only a single direction. The black dots shown near the bottom of the electrolysis reactor 320 represent particles of solid carbon. The open bubbles shown on the anodes 306 represent oxygen bubbles. The open bubbles under inlet 302 represent a feed of carbon dioxide. FIG. 3C presents another view of the electrolysis reactor 320 shown in FIG. 3B.

In some cases, a heater (not shown) may be provided as part of the electrolysis reactor to help maintain a desired temperature of the molten carbonate salt electrolyte.

In certain embodiments, more than one electrolysis reactor may be provided. The reaction products produced in each electrolysis reactor may be combined (e.g., in a storage tank that may or may not be heated, or in combined piping that is heated), or they may be maintained and processed separately. One advantage to using multiple electrolysis reactors in a system for producing and purifying solid carbon is that this configuration allows for simplified scaling. It is relatively easy to accommodate multiple electrolysis reactors in a unified system. Further, it is relatively easy to attach additional electrolysis reactors in the system, even after the system is implemented. Thus, if a user desires to increase throughput beyond their current reactor capacity, they can simply attach additional electrolysis reactors as needed. Depending on the throughput and size of the various components in the system, additional grinders, washers, extraction vessels, evaporation reactors, etc. may be provided to accommodate the increased load from the additional electrolysis reactors, if needed. The configurations described herein enable efficient use of space, capital, and materials.

Electrolyte storage tanks and/or slurry storage tanks may be implemented in single reactor as well as multi-reactor systems. In some cases, the storage tanks may be configured to hold "hot" electrolyte, which is typically for immediate use (e.g., for recirculation into a reactor). The storage tanks may also be configured to hold "cold" electrolyte, for example in a silo which is physically separated from the reactor by some distance. Typically, silos are used where the electrolyte/slurry will be used at some later time. Additionally, separation of carbon from the carbon-electrolyte slurry may occur at a location which is separated from the reactor by some distance. In some cases, for example, the reactor or reactors may be located in a first room or first building, and the separator is located in a second room or second building. Optimal placement of the apparatus components depends upon the space available, whether and where storage tanks are used, where the separated graphite is used, energy considerations, etc. For example, a holding furnace, where used, should be kept at a reasonable distance from the electrochemical cell. Design considerations include minimizing the amount of heat that must be added/captured to maintain the electrolyte in a molten state, as well as capital costs associated with construction and maintenance of the reactor/plant, and cost considerations relating to service/repair of individual system components.

Electrolytic reactors for forming carbon from molten carbonate salt electrolyte are further described in U.S. Pat. No. 9,290,853, titled "ELECTROLYTIC GENERATION OF GRAPHITE," which is herein incorporated by reference above.

The optimal distance between the cathode and anode in each reaction chamber (the "cathode-anode separation") depends on various factors including, but not limited to, the reactor size, the fluid transport properties of the electrolyte, and the graphite removal mechanism employed. The cathode-anode separation should be kept at a distance that minimizes the voltage drop across the electrolyte while maintaining optimal removal of graphite from the cathode. In certain embodiments, the cathode-anode separation in each reaction chamber is between about 1 and 50 millimeters. The cathode-anode separation will generally be wider where the carbon is removed via a scraper mechanism as opposed to a vibrating mechanism.

The overall dimensions of the reactor are flexible, and should be chosen based on, among other factors, the desired throughput of the reactor. In certain implementations, the reactor may be between about 1-3 meters long in its principal direction. In other embodiments, the reactor may be smaller or larger than this range.

Various aspects of the apparatus design (e.g., the electrolysis reactor or other components of the system) may utilize conventional features used in the smelting aluminum industry or in other high temperature, high-reaction rate electrochemical processes known in the art. Such features may relate to pumps, liquid-solid separators, piping, power supplies, temperature and pressure sensors, etc.

a. Cathode Structure and Construction

The materials from which a cathode is constructed should resist degradation at the temperature and electrochemical conditions of operation. Examples include titanium, stainless steel, graphite, iron, and silver. Other materials that may be suitable in some implementations include gold and platinum. In certain embodiments, the cathode may be made of an alloy containing one or more of the listed materials. In all cases, the electrode material may be made of solid bulk material, or may be porous. In some embodiments, the electrode material contains nano-scale materials, particularly on a surface exposed to electrolyte.

In some implementations, the cathode surface is designed to facilitate the electrochemical reduction of carbonate ions to form elemental carbon, particularly graphite, nanotubes, and/or other favored forms of solid carbon. In some implementations, the cathode is designed to improve the kinetics of the electroreduction reaction. The surface condition of the cathode may bias the formation of graphite, nanotubes, or other desired material by making the deposition reaction of such material kinetically favorable. Also, as explained above, the surface condition may provide a template for deposition of graphite, nanotubes, or other desired form of carbon. As mentioned, the cathode surface may contain a carbide or graphite itself, and may have a rough and/or patterned surface to promote formation of a desired type of carbon. Any material that promotes a high-quality graphite deposit may be used. Further, in cases where carbon dioxide is delivered directly to the electrolysis reactor, the cathode may incorporate a gas diffusion mechanism to help promote the diffusion of $CO_2$ to the surface of the cathode where it is consumed. The gas diffusion mechanism increases mass transfer to the cathode and thereby allows the deposition reaction to proceed at a relatively high rate.

In certain embodiments the gas diffusion mechanism is a gas diffusion electrode. In other embodiments, there is a gas diffusion system that is used in conjunction with the cathode. In implementations using a gas diffusion electrode, $CO_2$ enters into the porous gas diffusion cathode and diffuses into the active cathode surface where it is reduced to form solid carbon. This component may significantly increase delivery of $CO_2$ to the cathode and thereby increase the rate of formation of solid carbon.

The cathode will typically have a structure that allows solid carbon to be separated from the body of the electrode where it deposits.

In one approach, the cathode electrode is vibrated at its resonance frequency or near resonance to drive off carbon that is electrochemically generated at and attached to the cathode. A related or overlapping technique is sonication. The carbon that detaches from the electrode is then suspended in the electrolyte as a slurry and must be separated and purified as described herein.

The resonance frequency of the electrode is a function of the electrode material and physical dimensions. The resonance frequency further depends on the fluid in which the electrode is immersed. By vibrating the cathode at its resonance frequency (or at approximately its resonance frequency, e.g., within about 5%, or within about 10% of the resonance frequency), the amplitude of vibration may be maximized, thus producing good carbon removal results. In some implementations the cathode may be mechanically coupled to an oscillator tuned to the resonance frequency of the cathode. In certain cases, however, such motion will not produce significantly large displacements due to the motion of the cathode being dampened by the electrolyte. This damping may be an especially important consideration where a highly viscous electrolyte is used.

In one implementation, the cathode is a stainless steel cathode 100 centimeters long, 10 centimeters wide and 1 centimeter thick. In a vacuum, this cathode (acting as a cantilever) has a resonance frequency of about 8 Hz. In a typical molten carbonate electrolyte, the resonance frequency decreases according to Sader's Theory to about 5 Hz.

In another implementation, the cathode is a stainless steel cathode 50 centimeters long, 20 centimeters wide and 1 centimeter thick. In a vacuum, this cathode (acting as a cantilever) has a resonance frequency of about 33 Hz. In a typical molten carbonate electrolyte, the resonance frequency of the cathode decreases to about 15 Hz.

In an alternative implementation, the cathode itself may move back and forth to dislodge carbon from the surface of the cathode. In certain cases the cathode may move up and down, along a z-axis normal to the surface of the electrolyte. In other cases the cathode may move laterally along the longitudinal axis of the cathode. Such motion can be driven by fixing the cathode to a cam that drives the motion by use of an external circuit. Further details regarding the cam configuration are described below. In such implementations, part of top of the cathode may need to be electrically isolated from rest of the cathode in order to prevent a short circuit. The velocity of the cathode as it moves back and forth may be between about 2-50 cm/s, between about 10-45 cm/s, or between about 15-30 cm/s. Although this implementation consumes electrical power by driving the cam, it may reduce the overall energy footprint of the process.

In another approach, a scraper is used to mechanically scrape the surface of the electrode to remove the carbon that is deposited thereon. In some cases, the electrode or the scraper will rotate with respect to the other one in order to provide a fresh cathode surface for carbon deposition. While in certain embodiments the rotation is continuous, providing a consistently fresh cathode surface, in other embodiments the rotation is periodic. In some implementations, a blade for scraping the surface is maintained a fixed distance (e.g., between about 1 and 50 mm, between about 10 and 50 mm, or between about 25-50 mm) from the electrode surface, so that only the freshly deposited carbon is scraped from the surface. In these implementations, a layer of relatively permanent carbon remains on the cathode surface and is not removed by the scraper. In some embodiments, the scraper and cathode move relative to one another but do not rotate. For example, in one embodiment the cathode is a vertical cylindrical electrode and the scraper is a hollow disc-shaped scraper that fits around (or partially around) the cathode. The scraper may move vertically along the cathode's axis of rotation, thereby scraping off deposited carbon as the scraper contacts the surface of the cathode. Similarly, the scraper may have a fixed position and the cathode may move vertically such that the deposited carbon is scraped off by the scraper as the cathode moves. In certain embodiments, a motor may be used to drive the motion of the scraper and/or cathode and/or anode.

Regardless of the approach employed to remove the carbon from the surface, the removal may be applied continuously or intermittently. Where intermittent removal is used, the quality of carbon produced at a given time may affect the optimal removal frequency. The quality of carbon produced may vary over the course of deposition. For example, in some implementations the carbon (e.g., graphite) may generally increase in quality (e.g., have a higher crystallite height) as more carbon is deposited. As such, where periodic removal techniques are employed, it may be beneficial to have relatively longer times between removal operations. However, the carbon should be removed before it becomes so thick as to impair the carbon removal process. In certain implementations, the quality of carbon may decrease over time, or may begin to decrease after a threshold time or carbon thickness is reached. In such cases, the carbon should be removed before the quality of carbon reaches below a desired level. In implementations where carbon removal is periodic, such removal may occur after about every 1 to 60 minutes, after about every 1 to 2 hours, or after about every 2-4 hours.

b. Anode

As with the cathode, the anode materials of construction should resist degradation at the temperature and electrochemical environment of operation. The surface of the anode may contain a material that facilitates the conversion of oxide anion to oxygen. Such material may improve the kinetics of the oxidation reaction.

In one implementation, the anode is made of (or coated with) nickel. The nickel material provides good resistance to degradation under alkaline conditions. A layer of nickel oxide (NiO) may form on the surface of the electrode. It is believed that the layer of nickel oxide will not impair the function of the electrode, and may in fact act to protect the electrode. In other implementations, the anode may be made of (or coated with) iridium, platinum, titanium, lead dioxide on titanium, tin dioxide, steel, stainless steel, or alloys including one or more of the listed materials. Various nickel-containing electrodes may be used, especially where the surface of the electrode is treated to favor the formation of oxygen. Many other anode compositions are possible, and the foregoing list is not intended to be limiting.

In some cases, one or more hoods may be provided to capture oxygen as it bubbles out of the electrolyte. The hood may direct the evolved oxygen to a gas outlet. Hoods may be particularly useful in embodiments that feed carbon dioxide directly to the electrolysis reactor, such that the incoming carbon dioxide feed is maintained separate from the evolved oxygen. In many cases, carbon dioxide is not fed to the electrolysis reactor, and the hoods are omitted.

Figure 3D:
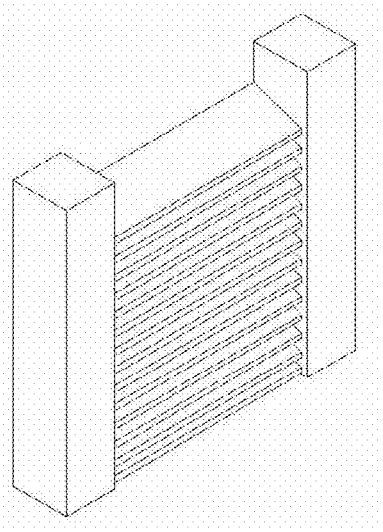
FIG. 3D depicts a louvered anode that may be used in an electrolysis reactor in some embodiments.

The anode may be designed to minimize gas phase buildup on the surface of the anode. For example, in certain embodiments the anode may be coupled with a cam shaft and spring configuration which allow the anode to move back and forth to dislodge bubbles that may otherwise accumulate on the anode surface. Another method to promote efficient removal of oxygen from the anode is to use a louvered anode having slits to encourage the oxygen to escape the reaction chamber via a certain path. An example of a louvered anode is shown in FIG. 3D. Gas phase oxygen buildup at the anode is undesirable because the bubbles increase the resistivity of the system, meaning that there is a larger voltage drop and correspondingly slower plating at the cathode.

For example, gas evolution from smooth and flat electrodes has been observed for the anodic evolution of $O_2$, as in the case of zinc electrowinning plants where lead dioxide covered lead ($P_bO_2$ covered Pb) anodes are used at high current densities, up to 500 mA/cm$^2$. Better performance is generally achieved by modifying the electrode to include slits or holes to assist the escape of gas bubbles towards the back of the electrode.

Figure 3E:
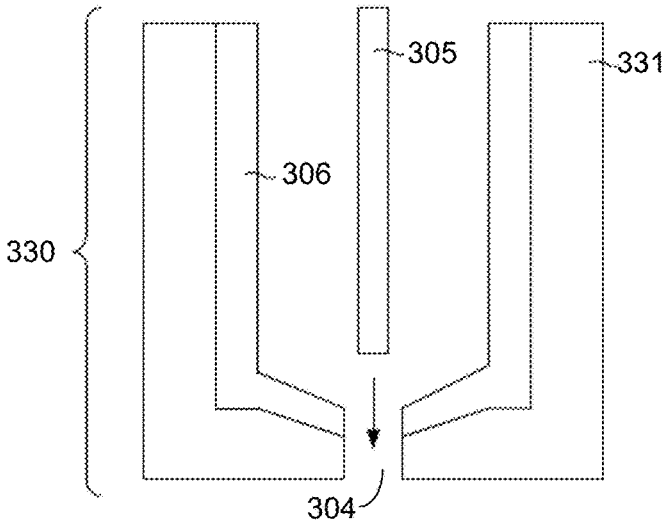
Figure 3F:
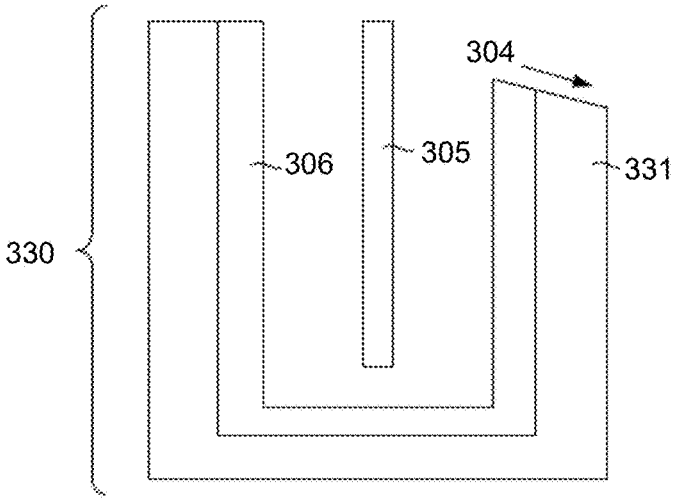

FIGS. 3E and 3F show cutaway views of alternative embodiments of an electrolysis reactor 330. In these embodiments, the electrolysis reactor 330 includes a vessel-shaped anode 306 surrounded by an insulator 331. The insulator may be made from ceramic or any other suitable material. The reaction vessel shown in FIG. 3E is radially symmetric and has an outlet 304 positioned at the bottom of the vessel. The inside surface of the electrolysis reactor 330 is the anode 306. The cathode 305 extends through the center of the vessel. The outlet 304 may connect with other components of the system as described herein. This type of reaction vessel design may be beneficial where the graphite or other product produced is about equally or more dense than the electrolyte used, as the dense product will tend to fall to the bottom of the electrolysis reactor 330 after it is dislodged from the cathode 305. From there, it can exit via the outlet 304 at the bottom of the vessel. The electrolysis reactor 330 shown in FIG. 3F is radially asymmetric and includes an outlet 304 positioned at a lowered side wall of the vessel. In this implementation, the electrolyte resides in the space defined by the vessel-shaped anode 306. The cathode 305 extends through the center of the vessel. The level of electrolyte during operation is sufficiently high such that excess electrolyte spills over a lowered side wall and exits at outlet 304. As in the previous design shown in FIG. 3E, the outlet 304 may connect with other components of the system as described herein. This design may be beneficial where the graphite or other product produced is less dense than the electrolyte used, for example, where the carbon produced is particularly porous.

c. Electrochemical Cell Container and Other Containers Holding Molten Electrolyte The electrochemical cell container (i.e., the reactor housing for the electrolysis reactor, and any other containers or pipes used to store or transport molten electrolyte) must resist degradation by a high temperature molten electrolyte. Appropriate insulation and temperature resistant materials should be used in the construction. Examples of suitable materials include graphite, ceramics, alumina, composite materials, and similar materials that meet the mentioned requirements. In general, suitable materials of construction are those used in cells for aluminum smelting and certain other electrolytic processes employing molten salt electrolytes.

The size of the cell container is large enough to efficiently generate carbon at a high rate. In certain embodiments, the chamber has a nominal diameter (or other principal cross-sectional dimension) of about 1 to 3 meters.

In some embodiments, other containers are used in combination with the electrochemical cell container. For example, a storage container may be used to hold carbon/electrolyte slurry as it cools to form the solid reaction product. In another example, storage containers may be used to hold separated electrolyte and/or separated graphite after these materials leave a separator. These containers should likewise be made of a material that will withstand the high operating temperatures (e.g., 400-900° C.), and should also be resistant to corrosion. The materials recited above may be used to construct the electrochemical cell may also be used to construct these secondary containers.

d. Power Source

The power source employed to drive the electrochemical reactions and related purification process will be designed or chosen to meet the requirements of the reactor size. For industrial processes, the electrolysis reactor may require currents of ~50 kA. Considering all of the components in FIG. 2A or 2B, the total system may require currents on the order of about 50 kA. With respect to the electrolysis reactor, in certain embodiments, there will be a control mechanism in place that uses active feedback of temperature through the use of a thermocouple or other temperature sensor. The control mechanism may control the cell voltage (potentiostatic or potentiodynamic control). In other implementations, the control mechanism may control the cell current (amperostatic or amperodynamic control). In some implementations, the controller will employ a control algorithm for delivering voltage or current to the electrodes of the cell. Such algorithm may employ pulsing, ramping, and/or holding the cell potential and/or current at particular stages of the electrochemical process.

The power supply and control system, which may control one or more aspects of the electrolysis reactor and/or the system in which the electrolysis reactor is implemented, are discussed further below.

e. Contacts and Other Current Carrying Lines for the Electrodes

Bus bars and other power transmission structures will typically be employed to deliver electrical energy to the anode and cathode of the electrolysis reactor. As with various other aspects of the apparatus, industrial bus bar designs for smelting aluminum or for other high temperature, high-reaction rate electrochemical processes may be employed.

The foregoing describes certain presently preferred embodiments. Numerous modifications and variations in the practice of this invention will occur to those skilled in the art. Such modifications and variations are encompassed within the following claims. The entire disclosures of all references cited herein are incorporated by reference for all purposes.

3. The Grinder

Figure 4:
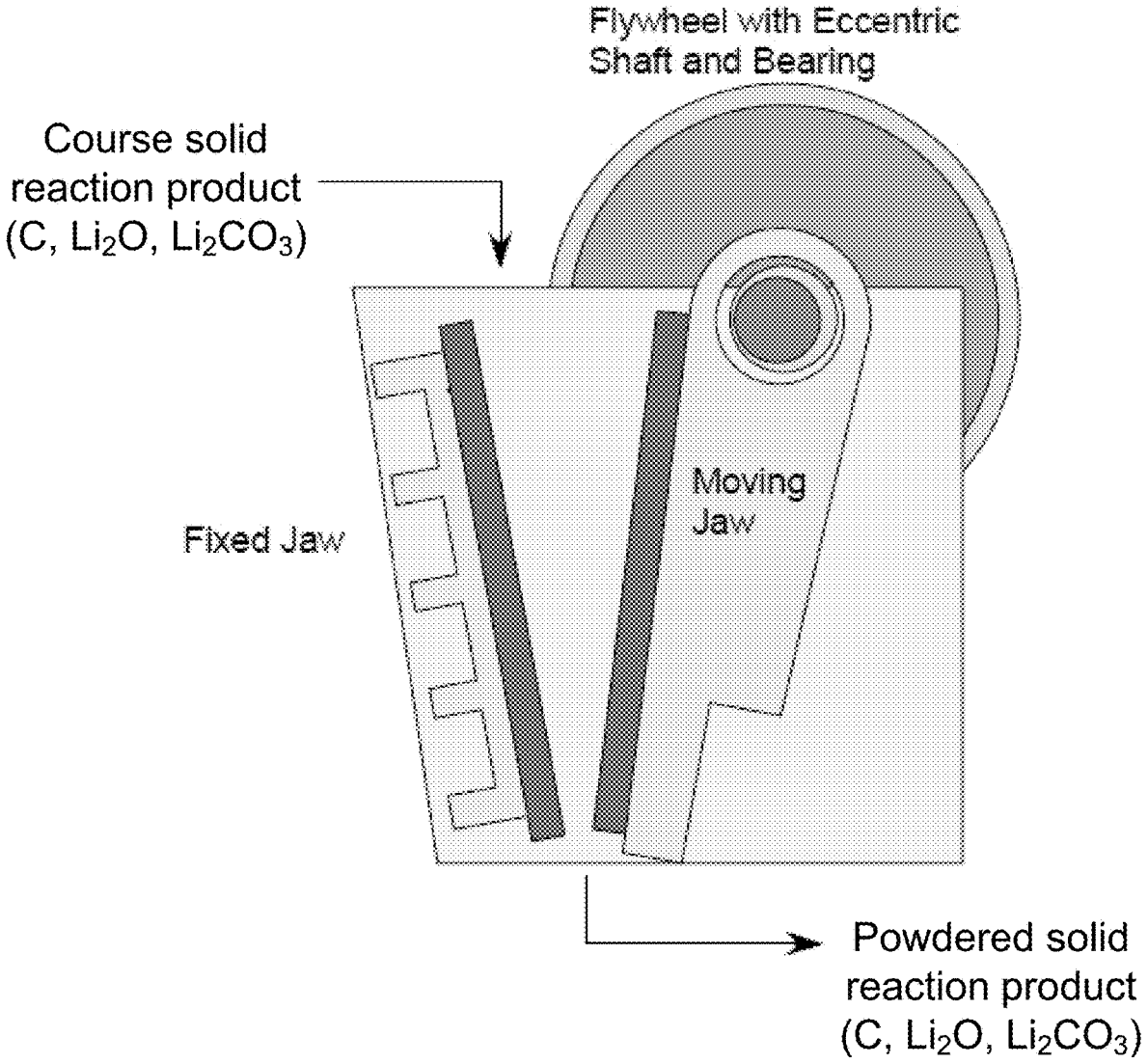
FIG. 4 illustrates a grinder that may be used to grind the solid reaction product into a powdered form according to certain embodiments.

The grinder is shown as element 204 in FIGS. 2A and 2B. The grinder is also shown in FIG. 4. The grinder receives the reaction product after it is cooled to form the solid reaction product. The solid reaction product is relatively course when it enters the grinder. The grinder includes mechanical components configured to grind the solid reaction product into a powder. Such components are shown in FIG. 4, and may include, e.g., a flywheel having an eccentric shaft and bearing, as well as a fixed jaw and a moving jaw. The flywheel operates to move the moving jaw, which grinds the solid reaction product against the fixed jaw as the reaction product passes through the jaws. The purpose of grinding the solid reaction product is to substantially increase the ratio of surface area to volume for the solid reaction product, which makes it easier for the carbon dioxide and hydrogen-donor solvent to penetrate into the solid reaction product in the extraction vessel, where it reacts with the lithium-containing compounds (e.g., lithium oxide, lithium hydroxide, and lithium carbonate) to form aqueous lithium bicarbonate. With reference to the system of FIG. 2B, the grinding also makes it easier for water to penetrate into the solid reaction product to react with lithium oxide to form lithium hydroxide in the washer, in cases where the solid reaction product is washed before providing it to the extraction vessel.

Generally speaking, the finer the solid reaction product is ground, the easier it is to extract the lithium compounds and purify the solid carbon. In some cases, the solid reaction product is ground until the average diameter of the particles is between about 0.5-5 mm.

The grinder may be powered by the same or different source that powers the electrolysis reactor.

4. The Washer

Figure 5:
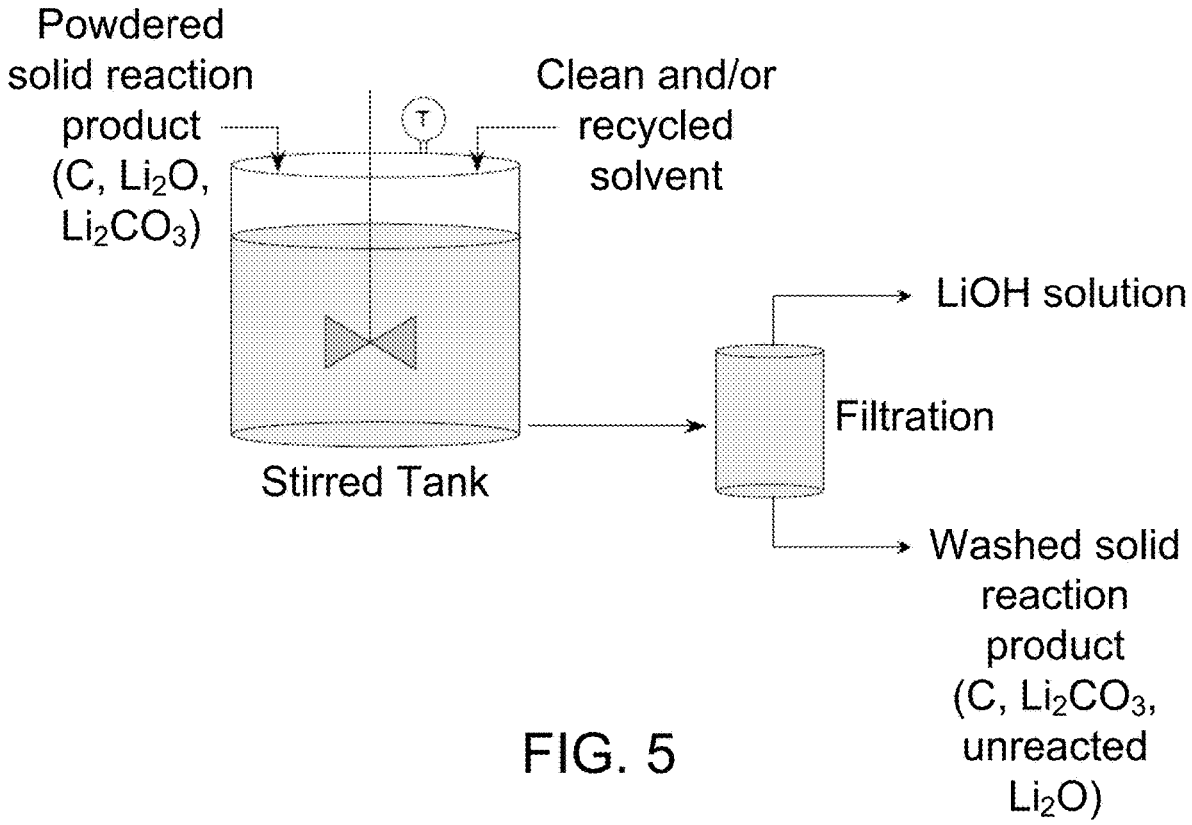
FIG. 5 shows a washer that may be used to wash the powdered solid reaction product in various implementations.

The washer is shown as element 206 in FIG. 2B. The washer is also shown in FIG. 5. The washer receives the solid reaction product, typically in powdered form after it leaves the grinder. In some cases, the washer may be omitted, as shown in FIG. 2A. The purpose of washing the solid reaction product is to react some portion of the lithium oxide in the solid reaction product with water to form aqueous lithium hydroxide. This provides a simple mechanism for recovering/removing a substantial portion of the lithium in the solid reaction product. In other words, washing the solid reaction product starts the process of purifying the solid carbon and (in some cases) recovering the lithium for recycling back to the electrolysis reactor.

The washer produces lithium hydroxide as the lithium oxide reacts with the water. In some cases, a solution of water and lithium hydroxide is formed. The lithium hydroxide can be sold, or it can be recycled to a precipitation reactor to form recovered lithium carbonate, which can be reused in the electrolysis reactor to produce further solid carbon.

The washer may be fed with water that is recycled from other system components (e.g., from the evaporation reactor and/or from the precipitation reactor). Alternatively or in addition, the washer may be fed with a fresh feedstock stream of water. In many cases, a combination of feedstock water (which is not recycled from another system component) and recycled water is used.

As shown in FIG. 5, the washer includes at least a tank, which is typically stirred with a mechanical stirrer. The washer may also include a temperature sensor that monitors the temperature within the tank. In addition, the washer may include a filter for separating the washed solid reaction product from the lithium hydroxide solution. The filter may be integral with the tank, or separate.

5. The Precipitation Reactor

Figure 6:
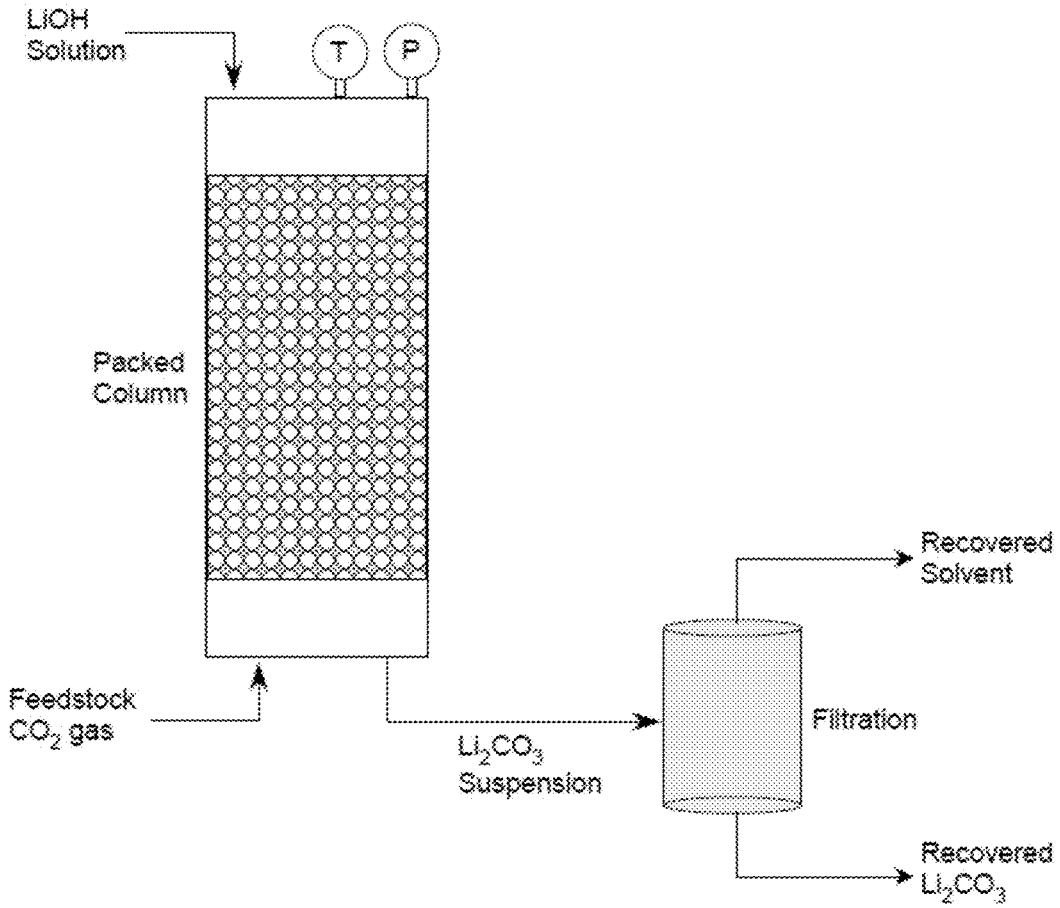
FIG. 6 depicts a precipitation reactor that may be used to regenerate lithium carbonate from lithium hydroxide and carbon dioxide in some embodiments.

The precipitation reactor for regenerating lithium carbonate from lithium carbonate from lithium hydroxide and carbon dioxide is shown as element 212 in FIG. 2B. The precipitation reactor is also shown in FIG. 6. In some embodiments this reactor may be omitted, as shown in FIG. 2A. The precipitation reactor is a packed column (or similar gas-liquid contacting reactor) that receives a solution of lithium hydroxide and a feedstock of carbon dioxide. In some cases, the feedstock of carbon dioxide may be supplemented with carbon dioxide recycled from another component of the system (e.g., from the evaporation reactor). The precipitation reactor may be operated to consume a substantial amount of carbon dioxide. The carbon dioxide reacts with the lithium hydroxide to form a suspension of lithium carbonate in water. This suspension can be passed to a filter to separate the components into recovered lithium carbonate and recovered solvent (e.g., recovered water in many cases). The filter may be integral with the packed column, or it may be separate. The recovered lithium carbonate can be sold, or it can be recycled to the electrolysis reactor for producing additional solid carbon. This provides an efficient and useful mechanism for converting carbon dioxide into solid carbon. The water produced in this reactor may be vented, or it may be recycled to another component of the system (e.g., to the washer or to the extraction vessel). The precipitation reactor may have a variety of sensors including a temperature sensor and a pressure sensor, as shown in FIG. 6.

6. The Extraction Vessel

Figure 7:
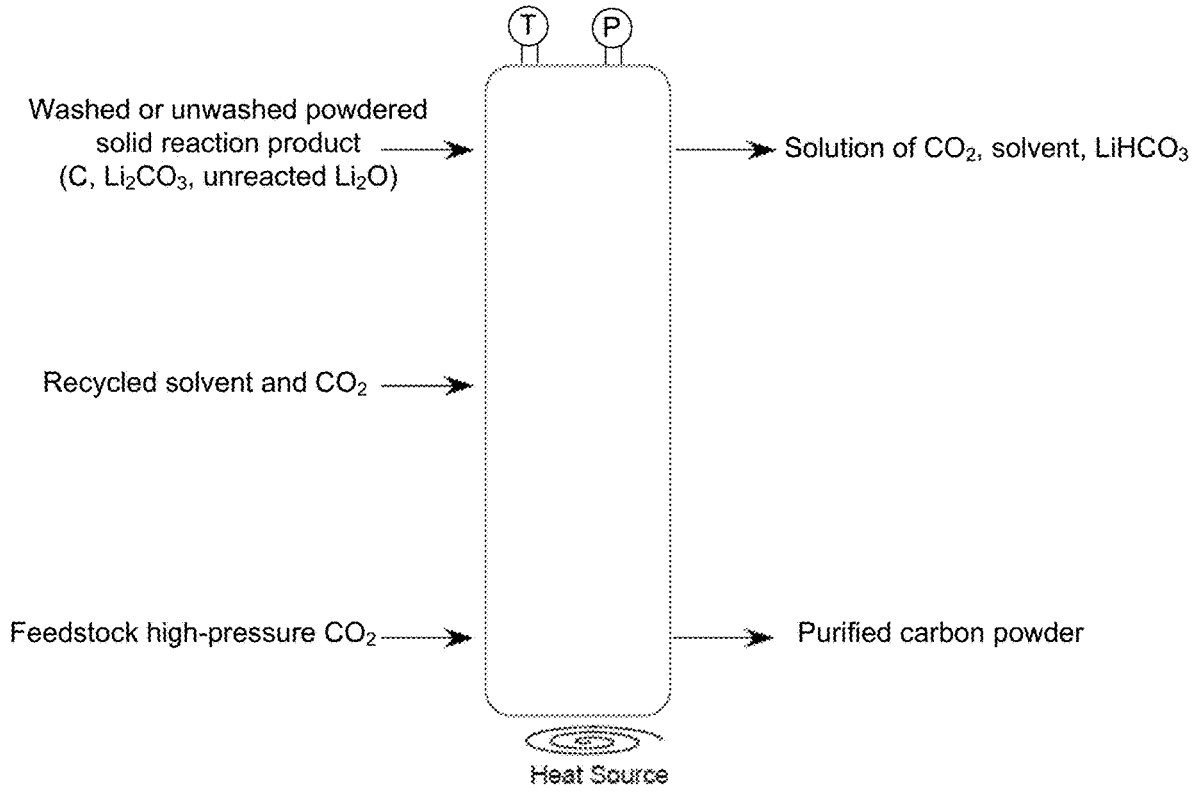
FIG. 7 shows an extraction vessel that may be used to purify carbon in some cases.

The extraction vessel is shown as element 208 in FIGS. 2A and 2B. The extraction vessel is also shown in FIG. 7. The extraction vessel receives solid reaction product, typically after it is ground into powdered form. In some cases, the extraction vessel receives solid reaction product that has been previously washed in a washer, as described above. Carbon dioxide and a hydrogen-donor solvent are also provided to the extraction vessel. Typically, a feedstock of fresh carbon dioxide is provided, as a substantial amount of carbon dioxide is consumed in the extraction vessel. In addition, a feed of recycled carbon dioxide (or recycled carbon dioxide mixed with water or other hydrogen-donor solvent) may be provided to the extraction vessel. The carbon dioxide may be supercritical in various embodiments. The carbon dioxide and water may be circulated within the extraction vessel as the solid carbon is being purified. Such circulation may result in faster purification. The extraction vessel may include various sensors including a temperature sensor and a pressure sensor, as shown in FIG. 7.

The extraction vessel may include a filter or other liquid-solid separator in some cases. The filter may operate to separate the purified solid carbon from the solution of carbon dioxide, hydrogen-donor solvent, and lithium bicarbonate. In other cases, such a filter or other liquid-solid separator may be provided separately from the extraction vessel.

7. The Evaporation Reactor

Figure 8:
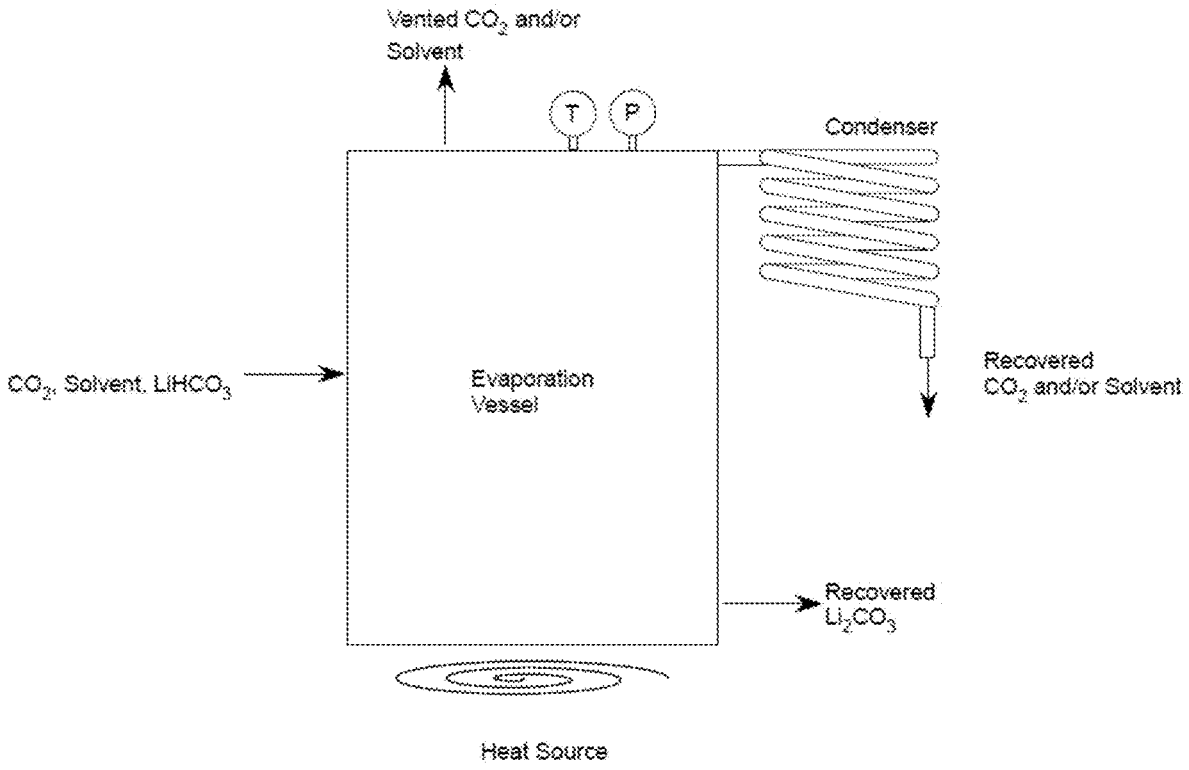
FIG. 8 depicts an evaporation reactor that may be used to form recovered lithium carbonate from a solution of lithium bicarbonate, carbon dioxide, and solvent according to certain implementations.

The evaporation vessel is shown as element 210 in FIGS. 2A and 2B. The evaporation reactor is also shown in FIG. 8. The evaporation vessel receives a solution of carbon dioxide, hydrogen-donor solvent, and lithium bicarbonate. The solution may also include some lithium carbonate (e.g., which may form from the lithium bicarbonate as the pressure on the solution is decreased). The solution may be provided to the evaporation reactor at any pressure. In various cases, the solution is provided to the evaporation reactor at an elevated pressure (e.g., the pressure at which the extraction vessel is run, or an intermediate pressure between atmospheric pressure and the pressure at which the extraction vessel is run). The pressure in the evaporation reactor can be actively lowered while the solution is in the evaporation reactor (or beforehand). The evaporation reactor may include various sensors, including a temperature sensor and a pressure sensor.

Providing a relatively low pressure (e.g., atmospheric or sub-atmospheric pressure) on the solution releases the carbon dioxide from the solution. Alternatively or in addition, the temperature in the evaporation reactor can be controlled (e.g., to an elevated temperature) to drive off the carbon dioxide. The carbon dioxide may be vented in some cases, and in other cases it may be recovered and recycled to another component of the system, e.g., to the extraction vessel and/or to the precipitation reactor. As the carbon dioxide vents from the solution, the aqueous lithium bicarbonate reverts to solid lithium carbonate, gaseous carbon dioxide, and liquid hydrogen-donor solvent. After the carbon dioxide vents from the solution, a mixture of solid recovered lithium carbonate in recovered hydrogen-donor solvent is left in the evaporation reactor. Some amount of the hydrogen-donor solvent may be vented off with the carbon dioxide, depending on the operating conditions in the evaporation reactor. The vented components may be vented to the environment (or another location), or they can be trapped and condensed, as shown in FIG. 8. The recovered lithium carbonate can be separated from the hydrogen-donor solvent using any known liquid-solid separation techniques. In some cases, a portion of the hydrogen-donor solvent is poured off from the mixture, and the recovered lithium carbonate may be dried and then sold or recycled. In these or other cases, a portion of the hydrogen-donor solvent is evaporated off from the mixture in the evaporation reactor (e.g., through the use of low pressure and/or high temperature). In these or other cases, the mixture of recovered lithium carbonate in recovered hydrogen-donor solvent may be passed through a filter or other liquid-solid separator. Various techniques may be used.

In some cases, the evaporation reactor may include a filter or other liquid-solid separator for separating the recovered lithium carbonate from the hydrogen-donor solvent. In other cases, such a filter or other separator may be provided separately.

8. The System Controller

In various embodiments, a controller is part of a system, and may be implemented in any of the examples described herein. Such systems can include any of the components described herein, for example those shown in FIGS. 2A and 2B. These components may be integrated with electronics for controlling their operation before, during, and after processing. The electronics may be referred to as the "controller," and they may include a number of different components or subparts of the system or systems. The controller may be programmed to control any and all of the processes described herein.

In some embodiments, the power supply and control system (collectively a controller) includes a processor, chip, card, or board, or a combination of these, which includes logic for performing one or more control functions related to the electrolysis reactor and/or any other component of the system. Some functions of the controller may be combined in a single chip, for example, a programmable logic device (PLD) chip or field programmable gate array (FPGA), or similar logic. Such integrated circuits can combine logic, control, monitoring, and/or charging functions in a single programmable chip.

In general, the logic used to control the electrical potential and current provided to the electrodes and/or the mechanisms for circulating electrolyte and/or the mechanisms for dislodging graphite from the cathode can be designed or configured in hardware and/or software. Similarly, the logic can control any aspect of the method described in FIG. 1 and/or the systems described in FIGS. 2A and 2B. Such aspects can include, but are not limited to, transfer of materials from one system component to another, operation of the grinder (e.g., power, mechanical settings controlling the resulting powdered reaction product, etc.), operation of the washer (e.g., temperature, pressure, circulation of fluids, timing, etc.), operation of a precipitation reactor for regenerating lithium carbonate from lithium hydroxide and carbon dioxide (e.g., temperature, pressure, circulation of fluids, timing, etc.), operation of the extraction vessel (e.g., temperature, pressure, circulation of fluids, timing, etc.), operation of the evaporation reactor (e.g., temperature, pressure, circulation of fluids, timing, etc.), etc. The instructions for controlling these aspects may be hard coded or provided as software. It may be said that the instructions are provided by "programming." Such programming is understood to include logic of any form including hard coded logic in digital signal processors and other devices which have specific algorithms implemented as hardware. Programming is also understood to include software or firmware instructions that may be executed on a general purpose processor. In some embodiments, instructions for controlling application of voltage to the batteries and loads are stored on a memory device associated with the controller or are provided over a network. Examples of suitable memory devices include semiconductor memory, magnetic memory, optical memory, and the like. The computer program code for controlling the applied voltage can be written in any conventional computer readable programming language such as assembly language, C, C++, and the like. Compiled object code or script is executed by the processor to perform the tasks identified in the program.

What is claimed is:

1. A system for producing and purifying carbon and recovering lithium carbonate, the system comprising:

an electrolysis reactor configured to produce a solid reaction product by reducing carbonate ions at a cathode in a molten carbonate salt electrolyte, wherein the molten carbonate salt electrolyte comprises lithium carbonate, and wherein the solid reaction product comprises carbon, lithium oxide, and the lithium carbonate from the molten carbonate salt electrolyte;

a grinder configured to receive the solid reaction product and grind it into a powdered form having an average particle diameter between about 0.5-5 mm;

a washer configured to contact the powdered form of the solid reaction product with water to react at least some of the lithium oxide with the water to form lithium hydroxide;

a filter configured to separate the lithium hydroxide from the solid carbon and lithium carbonate in the solid reaction product, thereby forming a filtered solid reaction product;

an extraction vessel configured to hold carbon dioxide, a hydrogen ion-donor solvent, and the filtered solid reaction product therein, wherein the extraction vessel is configured to reach a target pressure of at least about 1 atmosphere while the filtered solid reaction product, carbon dioxide, and hydrogen ion-donor solvent are held therein, thereby (i) producing lithium bicarbonate from the lithium carbonate, and (ii) forming a mixture comprising purified solid carbon and a solution of (a) the lithium bicarbonate, (b) the carbon dioxide, and (c) the hydrogen ion-donor solvent, wherein the target pressure is a total absolute pressure in the extraction vessel;

a separator for separating the purified solid carbon from the mixture;

an evaporation reactor configured to receive the solution after the purified solid carbon is removed from the mixture, wherein the evaporation reactor is configured to evaporate the carbon dioxide and the hydrogen ion-donor solvent from the solution to provide recovered lithium carbonate; and a precipitation reactor configured to react carbon dioxide with the lithium hydroxide to form a second recovered lithium carbonate and recovered water, wherein the electrolysis reactor is configured to receive the recovered lithium carbonate from the evaporation reactor.

2. The system of claim 1, wherein the extraction vessel is configured to receive the carbon dioxide removed from the solution from the evaporation reactor.

3. The system of claim 2, wherein the extraction vessel is configured to receive the hydrogen ion-donor solvent removed from the solution from the evaporation reactor.

4. The system of claim 1, wherein the cathode comprises a transition metal.

5. The system of claim 1, wherein an anode in the electrolysis reactor comprises a transition metal.

6. The system of claim 4, wherein the cathode comprises iron.

7. The system of claim 5, wherein an anode in the electrolysis reactor comprises stainless steel.

8. The system of claim 1, wherein the extraction vessel is configured to receive the recovered water from the precipitation reactor.

9. The system of claim 1, wherein the electrolysis reactor is configured to receive the second recovered lithium carbonate from the precipitation reactor to the electrolysis reactor.

10. A system for producing and purifying carbon and recovering lithium carbonate, the system comprising:

an electrolysis reactor configured to produce a solid reaction product by reducing carbonate ions at a cathode in a molten carbonate salt electrolyte, wherein the molten carbonate salt electrolyte comprises lithium carbonate, and wherein the solid reaction product comprises carbon, lithium oxide, and the lithium carbonate from the molten carbonate salt electrolyte;

a grinder configured to receive the solid reaction product and grind it into a powdered form having an average particle diameter between about 0.5-5 mm;

an extraction vessel configured to hold carbon dioxide, a hydrogen ion-donor solvent, and the powdered form of the solid reaction product therein, wherein the extraction vessel is configured to reach a target pressure of at least about 1 atmosphere while the solid reaction product, carbon dioxide, and hydrogen ion-donor solvent are held therein, thereby (i) producing lithium bicarbonate from the lithium carbonate, and (ii) forming a mixture comprising purified solid carbon and a solution of (a) the lithium bicarbonate, (b) the carbon dioxide, and (c) the hydrogen ion-donor solvent, wherein the target pressure is a total absolute pressure in the extraction vessel;

a separator for separating the purified solid carbon from the mixture; and an evaporation reactor configured to receive the solution after the purified solid carbon is removed from the mixture, wherein the evaporation reactor is configured to evaporate the carbon dioxide and the hydrogen ion-donor solvent from the solution to provide recovered lithium carbonate; and a precipitation reactor configured to react carbon dioxide with lithium hydroxide to form a second recovered lithium carbonate and recovered water, wherein the electrolysis reactor is configured to receive the recovered lithium carbonate from the evaporation reactor.

11. The system of claim 10, wherein the extraction vessel is configured to receive the carbon dioxide removed from the solution from the evaporation reactor.

12. The system of claim 11, wherein the extraction vessel is configured to receive the hydrogen ion-donor solvent removed from the solution from the evaporation reactor.

13. The system of claim 10, wherein the extraction vessel is configured to receive the recovered water from the precipitation reactor.

14. The system of claim 10, wherein the electrolysis reactor is configured to receive the second recovered lithium carbonate from the precipitation reactor.

* * * * *